US010350895B2

(12) United States Patent
Tanioku et al.

(10) Patent No.: US 10,350,895 B2
(45) Date of Patent: Jul. 16, 2019

(54) HEAD CLEANER AND LIQUID DISCHARGE APPARATUS

(71) Applicants: Yuichi Tanioku, Kanagawa (JP); Kazuki Suzuki, Kanagawa (JP); Taku Hatakeyama, Kanagawa (JP)

(72) Inventors: Yuichi Tanioku, Kanagawa (JP); Kazuki Suzuki, Kanagawa (JP); Taku Hatakeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/913,818

(22) Filed: Mar. 6, 2018

(65) Prior Publication Data

US 2018/0264822 A1 Sep. 20, 2018

(30) Foreign Application Priority Data

Mar. 15, 2017 (JP) ..... 2017-050256
Feb. 15, 2018 (JP) ..... 2018-025270

(51) Int. Cl.
*B41J 2/165* (2006.01)

(52) U.S. Cl.
CPC ..... *B41J 2/16535* (2013.01); *B41J 2/16538* (2013.01); *B41J 2/16541* (2013.01); *B41J 2002/1655* (2013.01)

(58) Field of Classification Search
USPC ..... 347/33
See application file for complete search history.

(56) References Cited

U.S. PATENT DOCUMENTS

2005/0007412 A1* 1/2005 Nishikawa ..... B41J 2/16588 347/33
2010/0231634 A1* 9/2010 Yokota ..... B41J 2/16538 347/17
2013/0250000 A1* 9/2013 Yamamoto ..... B41J 2/16535 347/33
2017/0066244 A1 3/2017 Fujioka et al.

FOREIGN PATENT DOCUMENTS

JP 2013-226807 11/2013

* cited by examiner

*Primary Examiner* — Lam S Nguyen
(74) *Attorney, Agent, or Firm* — Duft & Bornsen, PC

(57) ABSTRACT

A head cleaner to clean a liquid discharge head including a nozzle face in which nozzles are formed includes a wiper to wipe the nozzle face by moving relative to the liquid discharge head in a wiping direction. The wiper includes a wiper sheet, a blade having a higher water repellency than the wiper sheet, and a controller that controls the wiper to perform a first wiping operation and a second wiping operation. The first wiping operation involves wiping the nozzle face with the wiper sheet without bringing the blade into contact with the nozzle face, and the second wiping operation involves wiping the nozzle face with the wiper sheet and the blade by bringing the wiper sheet and the blade into contact with the nozzle face. The controller controls the wiper to perform the second wiping operation after performing the first wiping operation at least once.

7 Claims, 19 Drawing Sheets

HEAD CLEANER AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-050256, filed on Mar. 15, 2017 in the Japan Patent Office and Japanese Patent Application No. 2018-025270, filed on Feb. 15, 2018 in the Japan Patent Office, the entire disclosures of which are hereby incorporated by reference herein.

BACKGROUND

Technical Field

Aspects of this disclosure relate to a head cleaner and a liquid discharge apparatus.

Related Art

A liquid discharge apparatus such as an inkjet printer is known that wipes waste liquid adhered on a nozzle face of a liquid discharge head with a wiper sheet.

The inkjet printer has a problem in which waste liquid may remain on the nozzle face when the nozzle face is repetitively wiped with the wiper sheet because the waste liquid or cleaning liquid absorbed by the wiper sheet bleeds onto the nozzle face. The bleeding is especially prominent when wiping the nozzle face strongly and repeatedly over a short time.

SUMMARY

In an aspect of this disclosure, a novel head cleaner to clean a liquid discharge head including a nozzle face in which nozzles are formed, the head cleaner includes a wiper to wipe the nozzle face by moving relative to the liquid discharge head in a wiping direction. The wiper includes a wiper sheet, a blade having a higher water repellency than the wiper sheet, and a controller that controls the wiper to perform a first wiping operation and a second wiping operation. The first wiping operation involves wiping the nozzle face with the wiper sheet without bringing the blade into contact with the nozzle face, and the second wiping operation involves wiping the nozzle face with the wiper sheet and the blade by bringing the wiper sheet and the blade into contact with the nozzle face. The controller controls the wiper to perform the second wiping operation after performing the first wiping operation at least once.

In another aspect of this disclosure, a novel liquid discharge apparatus includes the head cleaner as described above.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
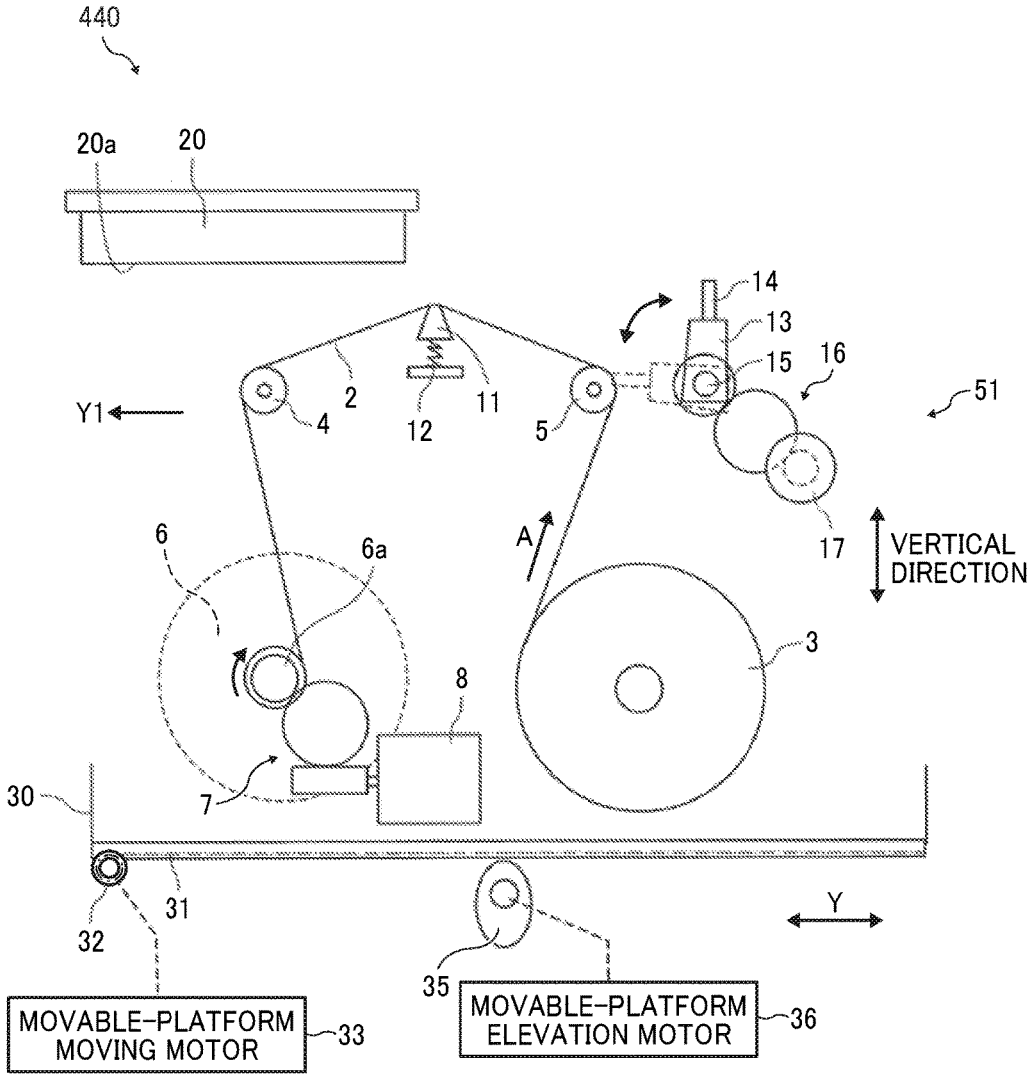
FIG. 1 is a schematic side view of a wiper according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

Hereinafter, embodiments of the present disclosure are described with reference to the attached drawings. A liquid discharge head according to an embodiment of the present disclosure is described with reference to FIGS. 1 through 3.

First Embodiment

A configuration of the wiper according to a first embodiment is described below with reference to FIGS. 1 and 2. Then, an example of a wiping operation using the wiper is described.

FIG. 1 is a side view of the wiper 51 according to the first embodiment. FIG. 2 is a plan view of the wiper 51 of FIG. 1. In FIGS. 1 and 2, a liquid discharge head 20 is illustrated for describing a configuration and an operation of the wiper 51 according to the present disclosure.

A head cleaner 50 according to a first embodiment (see FIG. 9) includes the wiper 51 that wipes a nozzle face 20*a* of the liquid discharge head 20 by moving relative to the head 20 in a wiping direction as indicated by arrow Y1 in FIG. 1. Note that the head cleaner 50 is a device for cleaning a liquid discharge head 20 and is also referred to as a maintenance unit.

Figure 3:
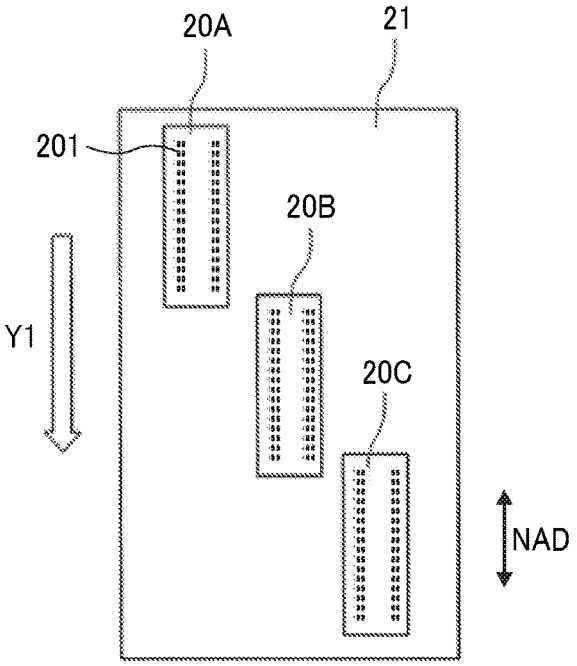
FIG. 3 is a bottom view of a carriage including a liquid discharge head according to the present disclosure.

Not also that the liquid discharge head 20 includes the nozzle face 20*a* in which a plurality of nozzles 201 is formed, and hereinafter is simply referred to as "head". As illustrated in FIG. 3, the head 20 includes the nozzle face 20*a* on which nozzles 201 for discharging liquid is formed. Further, in the following description, a device including the head cleaner 50 and the head 20 is also referred to as a "liquid discharge device".

The wiper 51 includes a web 2 and a blade 14. The web 2 is a belt-like sheet for wiping the nozzle face 20*a*. The web 2 is a wiper sheet serves as a first wiper that wipes the nozzle face 20*a* of the head 20 with the belt-like sheet. The blade 14 is an elastic blade serving as a second wiper. The blade is also referred to as a wiper or wiper blade. The web 2 and the blade 14 are held between the side plates 18 and 19 as illustrated in FIG. 2.

Preferably, the web 2 is made of a sheet-like material having good absorption and liquid resistance against at least the liquid to be used. Further, the web 2 is preferably made of material that does not generate fuzz or dust. Specific examples of such materials include, but are not limited to, non-woven fabric, cloth, film, and paper.

Preferably, the blade 14 is made of a material having lower absorbability than the web 2 and having elasticity, such as rubber or soft resin.

The web 2 is drawn from a feeding roller 3 and wound up by a winding roller 6 via conveyance rollers 4 and 5. The conveyance rollers 4 and 5 are rotatably supported by the side plates 18 and 19. The conveyance rollers 4 and 5 serve as guide rollers to guide the web 2. The feeding roller 3 is disposed upstream in a wiping direction Y1, and the winding roller 6 is disposed downstream in the wiping direction Y1 indicated by arrow Y1 in FIGS. 1 and 2. The web 2 is wound in a direction along the wiping direction Y1. Thus, a transporting direction A of the web 2 is in the same direction with the wiping direction Y1. The "wiping direction Y1" is a direction in which the wiper 51 moves relative to the nozzle face 20*a*.

A pressing member 11 is disposed between the two conveyance rollers 4 and 5. The pressing member 11 pushes the web 2 against the nozzle face 20*a*. The pressing member 11 has a spring 12 so that the pressing member 11 pushes the web 2 against the nozzle face 20*a* with a predetermined pushing force of the spring 12 when the web 2 contacts the nozzle face 20*a*.

Here, the wiper 51 may include a mechanism that varies a pressing force of the spring 12. The mechanism is described below in detail. The wiper 51 may control the pressing force of the spring according to a wiping interval (elapsed time since previous wiping operation). For example, the wiper may control the pressing force stronger with increase in the elapsed time. The control sequence is described below in detail.

Further, the wiper 51 may store information related to the pressing force corresponding to a tension of a material of the web 2. Then, the wiper 51 detects the material (type) of the web 2 and controls the pressing force according to the tension of the material of the web 2 when the web 2 of different material is exchanged and used.

A drive force of the drive motor 8 is transmitted to a shaft 6*a* of the winding roller 6 via a transmission mechanism 7 consisting of a gear train.

A code wheel 9 is mounted on a shaft 5*a* of the conveyance roller 5. An encoder sensor 10 is mounted on the code wheel 9 that detects a pattern formed on the code wheel 9. The encoder sensor 10 includes a transmissive photosensor. The code wheel 9 and the encoder sensor 10 configure a rotary encoder (sub-scanning encoder) that detects a moving distance (amount of movement) of the web 2.

The blade 14 is disposed upstream in the wiping direction Y1 of the web 2. The blade 14 is held by a blade holder 13. As a result, when the wiper 51 moves in the wiping direction Y1, the web 2 first comes into contact with the nozzle face 20*a*, and then the blade 14 can contact the nozzle face 20*a*. An end of a shaft 15 of the blade holder 13 is rotatably supported by the side plates 18 and 19.

The blade 14 is disposed upstream of a position where the web 2 contacts the nozzle face 20*a* (the position of the pressing member 11) in a moving direction (feeding direction) of the web 2 indicated by arrow A in FIG. 1. In other words, a cleaning position where the web 2 cleans the blade 14 locates upstream of a position where the web 2 contacts the nozzle face 20*a* in a moving direction A of the web 2.

The cleaning position is also the retracted position of the blade 14 at which the blade 14 does not contact the nozzle face 20*a*. The cleaning position for cleaning the blade 14 with the web 2 may also be a retracted position where the blade 14 does not contact the nozzle face 20*a*.

Thus, the wiper 51 can clean the nozzle face 20*a* without wasting time for cleaning the blade 14 since unused area of the web 2 always comes to the cleaning position of the blade 14. Further, an unused area of the web 2 between a position where the web 2 contacts the nozzle face 20*a* and the cleaning position can also be used for wiping. Thus, the wiper 51 can reduce wasteful consumption of the web 2.

The blade 14 may be disposed at the conveyance roller 4 side (downstream side of the pressing member 11) in the wiping direction Y1. That is, the blade 14 can also be disposed on the downstream side in the wiping direction Y1 with respect to the web 2. In this case, the nozzle face 20*a* is first wiped by the blade 14 and then wiped by the web 2. Thus, the position of the feeding roller 3 and the winding roller 6 may be exchanged in order to reverse the moving direction (feeding direction) A of the web 2.

That is, when the blade 14 is disposed on the downstream of the web 2 in the wiping direction Y1 and the moving direction A of the web 2 is the same as the wiping direction Y1, a portion of the web 2 that contacts the nozzle face 20*a* and get waste liquid by the nozzle face 20*a* moves to the cleaning position to clean the blade 14. Therefore, it is necessary to feed the web 2 until a non-dirty portion (unused portion) of the web 2 that has not contact the nozzle face 20*a* moves to the cleaning position for cleaning the blade 14. Thus, the unused area of the web 2 is wasted.

Thus, the wiper 51 includes the blade 14 (second wiper) positioned at the upstream of the web 2 (first wiper) in the moving direction A (feeding direction) of the web 2. The wiper 51 can reduce wasteful consumption of the web 2.

Further, a rotational force of a drive motor 17 such as a stepping motor is transmitted to the shaft 15 of the blade holder 13 via a transmission mechanism 16 consisting of a gear train. Thus, the drive motor 17 drives to rotate the blade holder 13.

Thus, the blade 14 is at least movable between the wiping position where the blade 14 is contactable with the nozzle face 20*a* and the cleaning position (retracted position) where the blade 14 contacts the web 2. The wiping position is indicated by solid line in FIG. 1, and the cleaning position is indicated by broken line in FIG. 1. The feeding direction (moving direction A) of the web 2 is a direction from upstream toward downstream in the wiping direction Y1. The cleaning position (retracted position) is disposed upstream of the position where the web 2 contacts the nozzle face 20*a*.

In this case, the cleaning position where the blade 14 contacts the web 2 is disposed at a position where the blade 14 faces the conveyance roller 5 that guides the web 2. Thus, the wiper 51 can reliably brought the web 2 into contact with the blade 14.

The web 2, the feeding roller 3, the winding roller 6, the conveyance roller 4 and 5, the transmission mechanism 7, the drive motor 8, the blade holder 13, the blade 14, the transmission mechanism 16, and the drive motor 17 as described above are mounted on a movable platform 30. The movable platform 30 is movable relative to the head 20. In the present embodiment, the above-described members such as the web 2 and the blade 14 are collectively referred to as the wiper 51. However, the present embodiment is not limited to the embodiments described above.

The movable platform 30 is reciprocally movable in a direction indicated by arrow Y (wiping direction Y1) in FIG. 1. The direction Y is along a nozzle array direction in which nozzles 201 are arrayed in a row indicated by arrow NAD in FIG. 3. The movable platform 30 is moved in the direction Y (wiping direction Y1) by a moving mechanism including a rack 31, a pinion 32, and a motor 33 that rotates the pinion 32 along the rack 31.

The movable platform 30 is also movable in a vertical direction in which the web 2 and the blade 14 advances or retracts relative to the nozzle face 20*a*. The movable platform 30 moves vertically by an elevation mechanism including a cam 35 and a motor 36 that rotates the cam 35.

FIG. 3 is a plan view of a carriage 21 mounting the head 20 as viewed from a bottom of the carriage 21. The carriage 21 mounts one or a plurality of heads 20 (20A to 20C). The plurality of heads 20 discharges desired colors of liquid from the nozzles 201 formed on the nozzle face 20*a* of the head 20 to form image on a sheet.

Next, a wiping operation of the wiper 51 is described.

As described above, the wiper 51 of the present embodiment at least includes the web 2 and the blade 14. The wiper 51 moves at least one of the web 2 and the blade 14 relative to the head 20 in the wiping direction Y1 to wipe the nozzle face 20*a* of the head 20.

[First Wiping Operation]

Figure 5A:
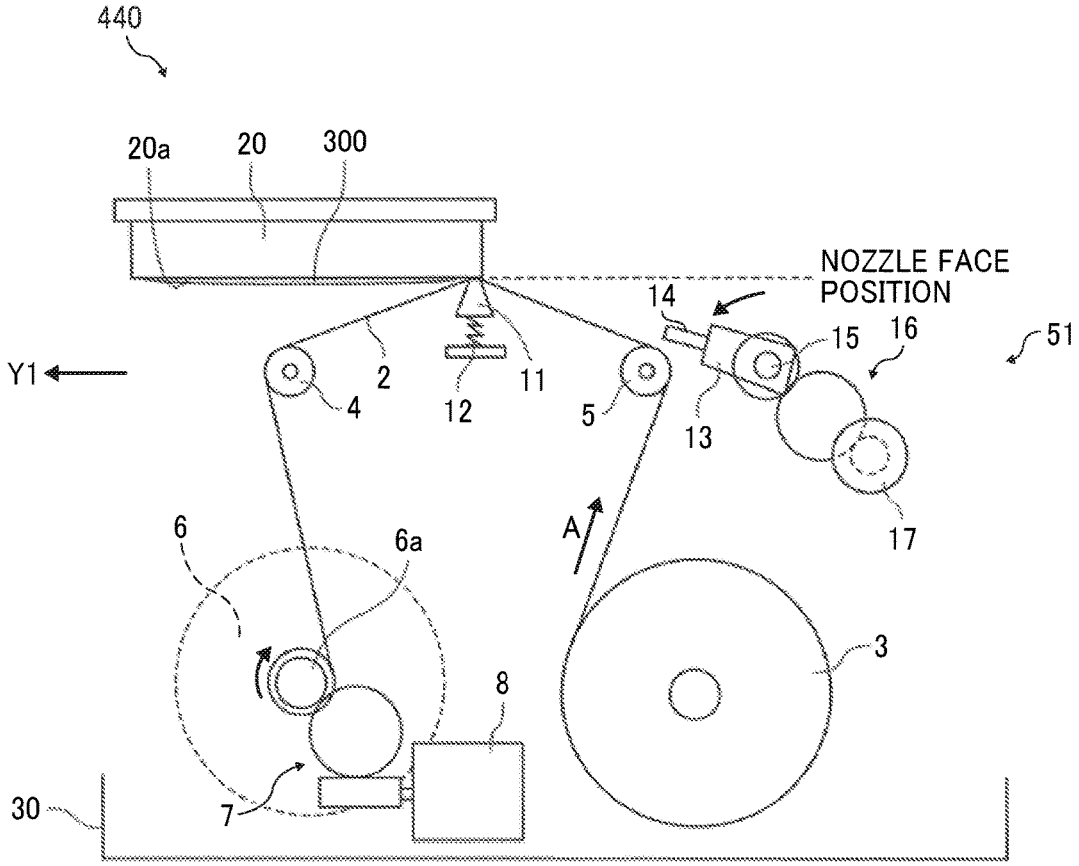
FIGS. 5A through 5D are side views of the wiper during the wiping operation.
Figure 5B:
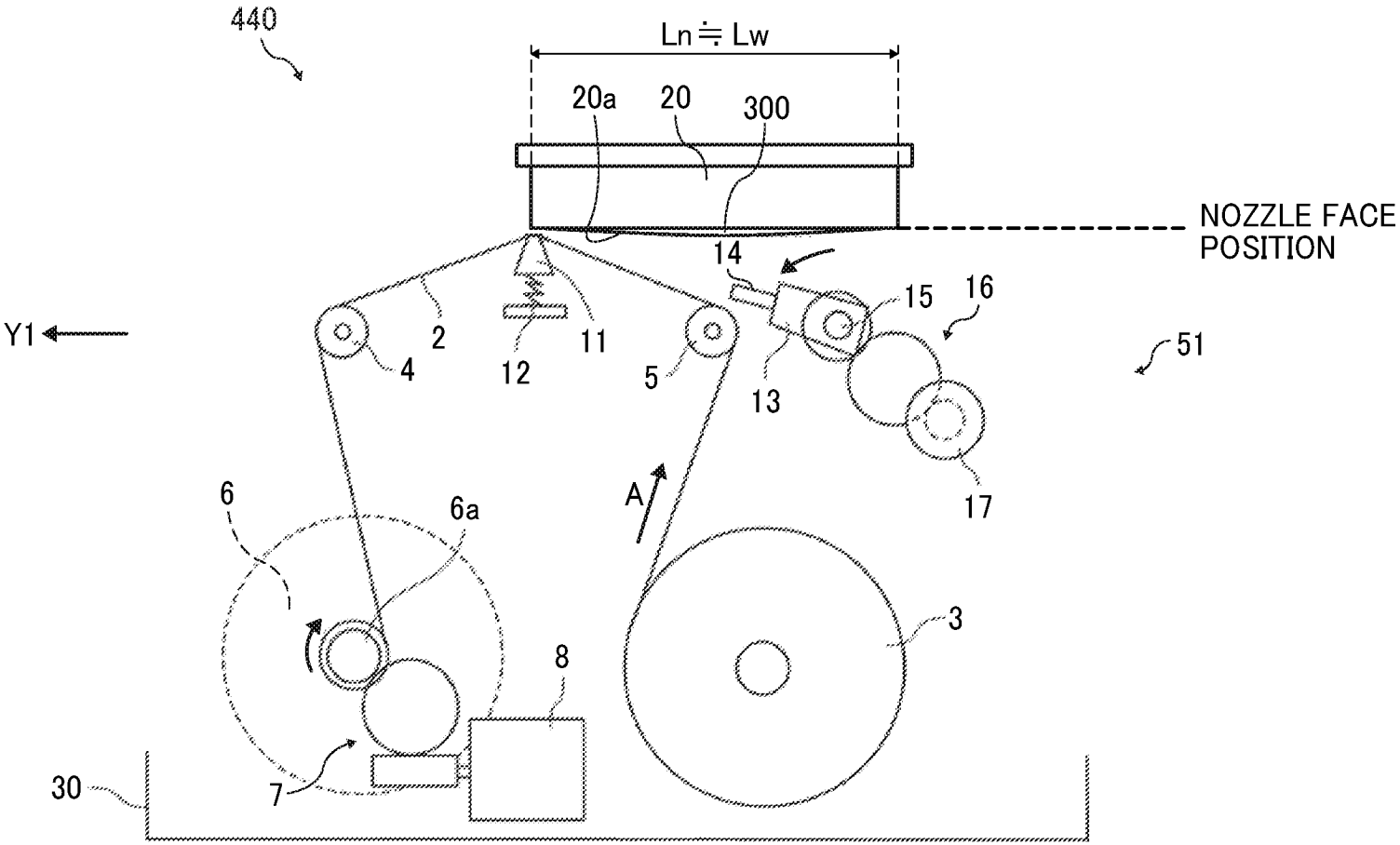
Figure 5C:
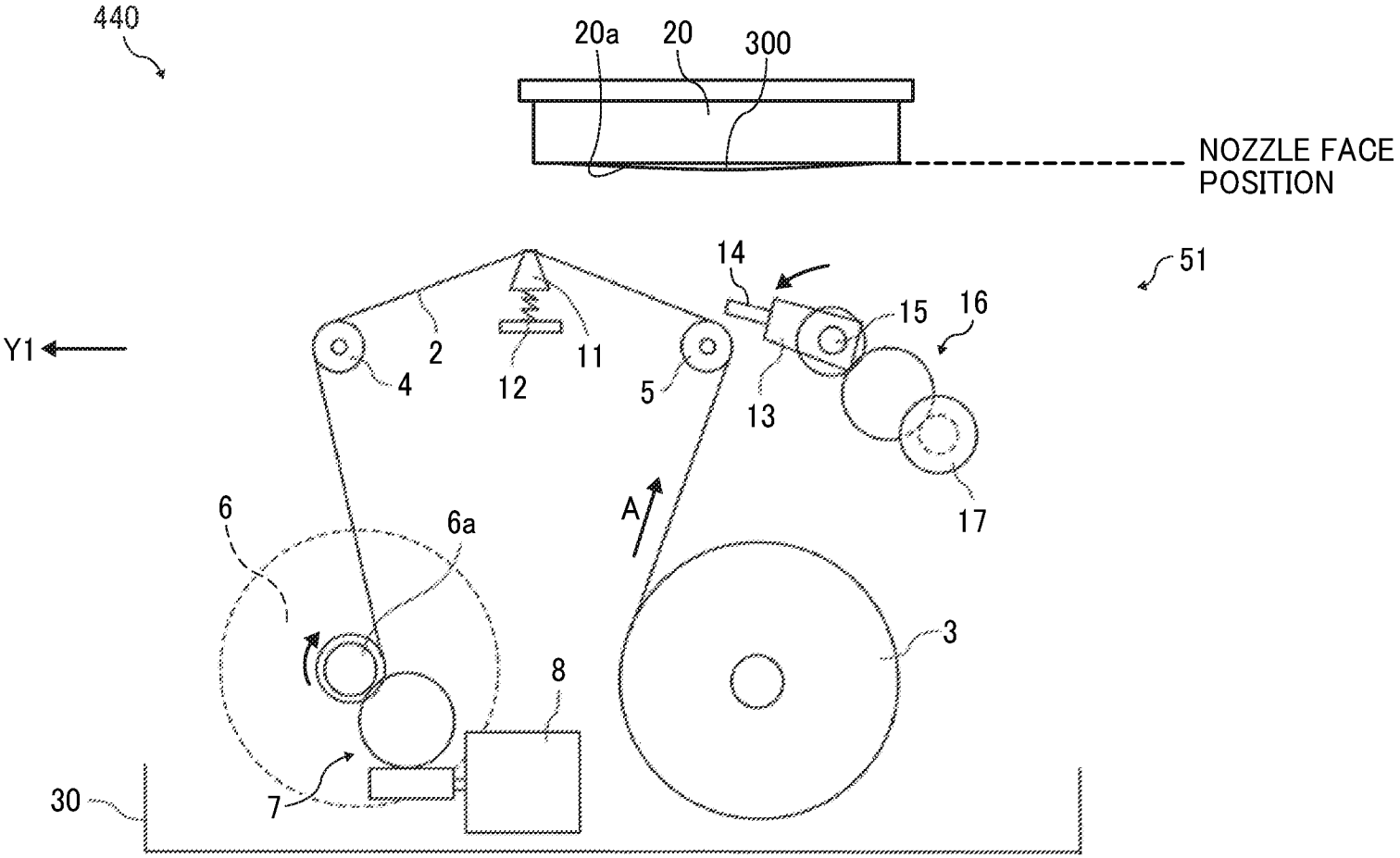
Figure 5D:
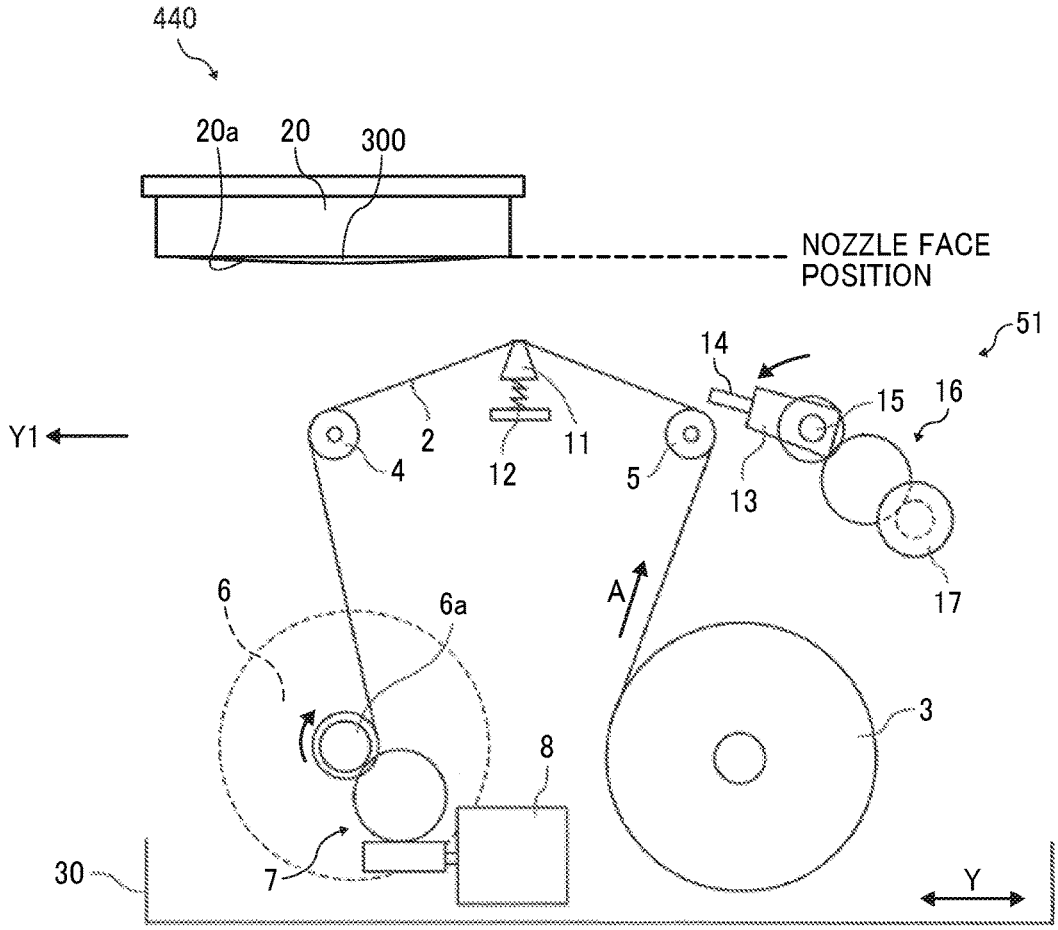

A wiping operation without using the blade 14 is described with reference to FIGS. 5A to 5D. In the present embodiment, the nozzle face 20*a* is wiped with only the web 2. FIG. 5A is a side view of the wiper 51 and the head 20 for describing the wiping operation at a wiping start position. FIG. 5B is a side view of the wiper 51 during the wiping operation with the web 2. FIG. 5C is a side view of the wiper 51 after the wiping operation. FIG. 5D is a side view of the wiper 51 and the head 20 at a wiping ending position.

As illustrated in FIG. 5A, the wiper 51 drives and controls the drive motor 17 to rotate the blade 14 in a counter clockwise direction as indicated by arrow so that the blade 14 rotates from a wiping position (nozzle face position indicated by dashed line) to a retracted position. Thus, the blade 14 moves (rotates) to the retracted position. The blade 14 does not contact the nozzle face 20*a* at a height of the retracted position.

At this time, the web 2 can absorb the waste liquid adhered on the blade 14 by bringing the blade 14 into contact with the web 2. An amount of rotation of the blade 14 and a duration of contact time between the web 2 and the blade 14 may be arbitrary set. The amount of rotation of the blade 14 corresponds to an amount of contact of the blade 14 with the web 2.

Further, a contact angle between an end of the blade 14 and the web 2 may be varied according to a hardness of material of the blade 14 or usage condition of the blade 14 such as wearing of the blade 14 due to aging, for example.

Next, as illustrated in FIG. 5B, the wiper 51 can wipe and remove the waste liquid adhered on the nozzle face 20*a* by moving the movable platform 30 in the wiping direction Y1 while pressing the web 2 to the nozzle face 20*a* with the pressing member 11. At this time, the blade 14 does not contact the nozzle face 20*a*.

As illustrated in FIG. 5B, the moving distance Lw of the movable platform 30 when the wiping operation completes can be made substantially equal to the distance Ln of the nozzle face 20*a* in the wiping direction Y1. The moving distance Lw of the movable platform 30 is a distance from a point where the pressing member 11 starts contacting the nozzle face 20*a* to a point where the pressing member 11 is positioned when the wiping operation completes. Here, the moving distance Lw of the movable platform 30 is equal to a moving amount of the web 2 in the wiping direction Y1.

As a result, the moving distance Lw of the movable platform 30 is shortened as compared with the case where the blade 14 is used for wiping, so that time used for the wiping operation can be shortened. Thus, this embodiment is particularly effective in the case where the same wiping operation is repeated plural times.

Then, as illustrated in FIG. 5C, the wiper 51 moves the movable platform 30 away from the nozzle face 20*a* and further moves the movable platform 30 to a position located before the wiping operation starts as illustrated in FIG. 5D. Then, the wiper 51 can wipe the nozzle face 20*a* by ascending the movable platform 30 and moving the movable platform 30 in the wiping direction Y1 again.

From a viewpoint of detergency, it is preferable to perform a next wiping operation after winding the web 2 contaminated by the previous wiping operation. From the viewpoint of reducing the time, it is preferable to perform the next wiping operation without winding the web 2.

Further, it is preferable to set wiping directions in the same one direction when repeating the first wiping operation multiple times. Generally, when the nozzle face 20*a* is wiped, waste liquid is often solidified and accumulated on an edge portion of the nozzle face 20*a* in the wiping direction Y1. The accumulated solidified ink often forms a stalactite-shaped sediment on the edge portion of the nozzle face 20*a* that cause various troubles such that the accumulated ink attaches to and blot the sheet at the time of image formation.

If the wiping direction is switched alternately such as reciprocally wiping the nozzle face 20*a* on both directions, time taken for the wiping operation can be shortened. However, the accumulated solidified ink may form a stalactite-shaped sediment on both sides of the edge portion of the nozzle face 20*a*.

Thus, the accumulated ink may cause many of the above-mentioned problems. Accordingly, the wiping direction is set in the same one direction when repeating the first wiping operation multiple times to limit a formation of a stalactite-shaped accumulated ink on one end side of the nozzle face 20*a* and to minimize the trouble.

The controller 500 controls the wiper 51 to perform the first wiping operation and a second wiping operation. The first wiping operation wipes the nozzle face 20*a* with the web 2 without bringing the blade 14 into contact with the nozzle face 20*a*.

The wiper 51 performs the second wiping operation after performing the first wiping operation at least once. Hereinafter, examples of a first wiping operation, a second wiping operation, and a strong cleaning combining the first wiping operation and the second wiping operation are described.

[Second Wiping Operation]

A wiping operation according to the present embodiment is described below with reference to FIGS. 4A through 4C. The second wiping operation wipes the nozzle face 20*a* with the web 2 and the blade by bringing the web 2 and the blade 14 into contact with the nozzle face 20*a*. Thus, the second wiping operation uses the web 2 and the blade 14.

Figure 4A:
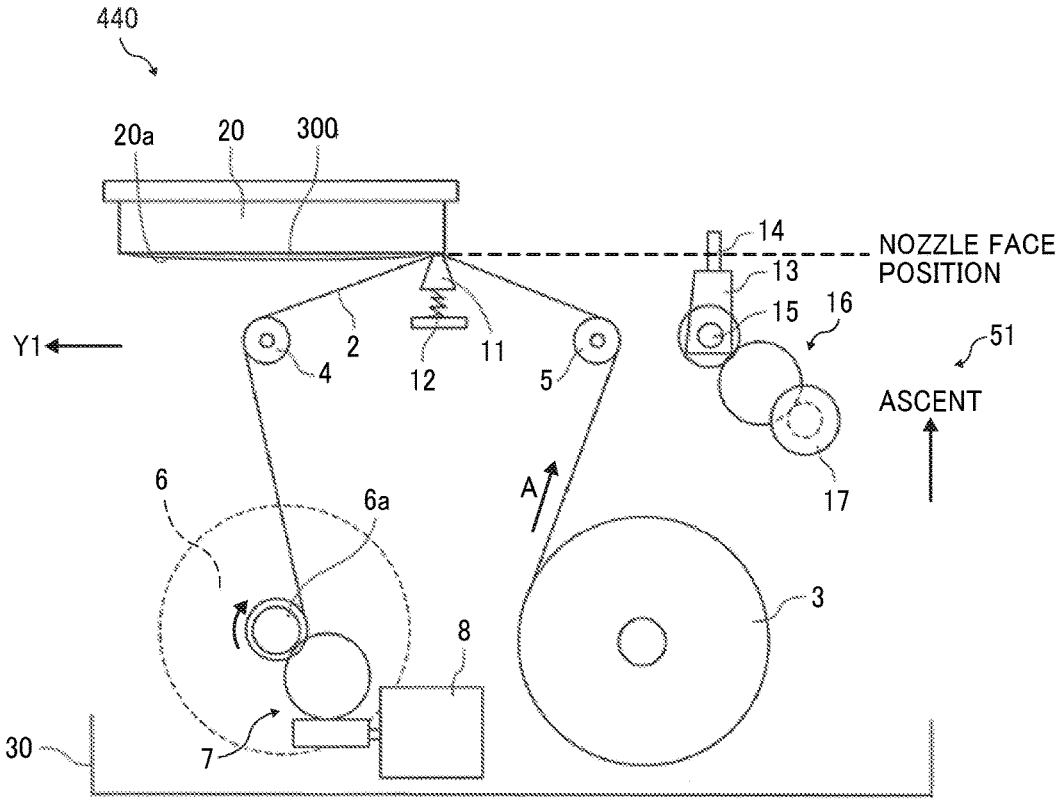
FIGS. 4A through 4C are side views of the wiper during a wiping operation.

FIG. 4A is a side view of the wiper 51 and the head 20 at a wiping starting position. FIG. 4B is a side view of the wiper 51 and the head 20 during the wiping operation. FIG. 4C is a side view of the wiper 51 and the head 20 at a wiping ending position.

As illustrated in FIG. 4A, when the nozzle face 20*a* of the head 20 is wiped by the wiper 51, the movable platform 30 ascents, and the web 2 is pushed against one end part of the nozzle face 20*a* of the head 20 with a predetermined pushing force. This one end part of the nozzle face 20*a* becomes the wiping start position of the web 2. At this time, the blade 14 does not contact the nozzle face 20*a*.

Figure 4B:
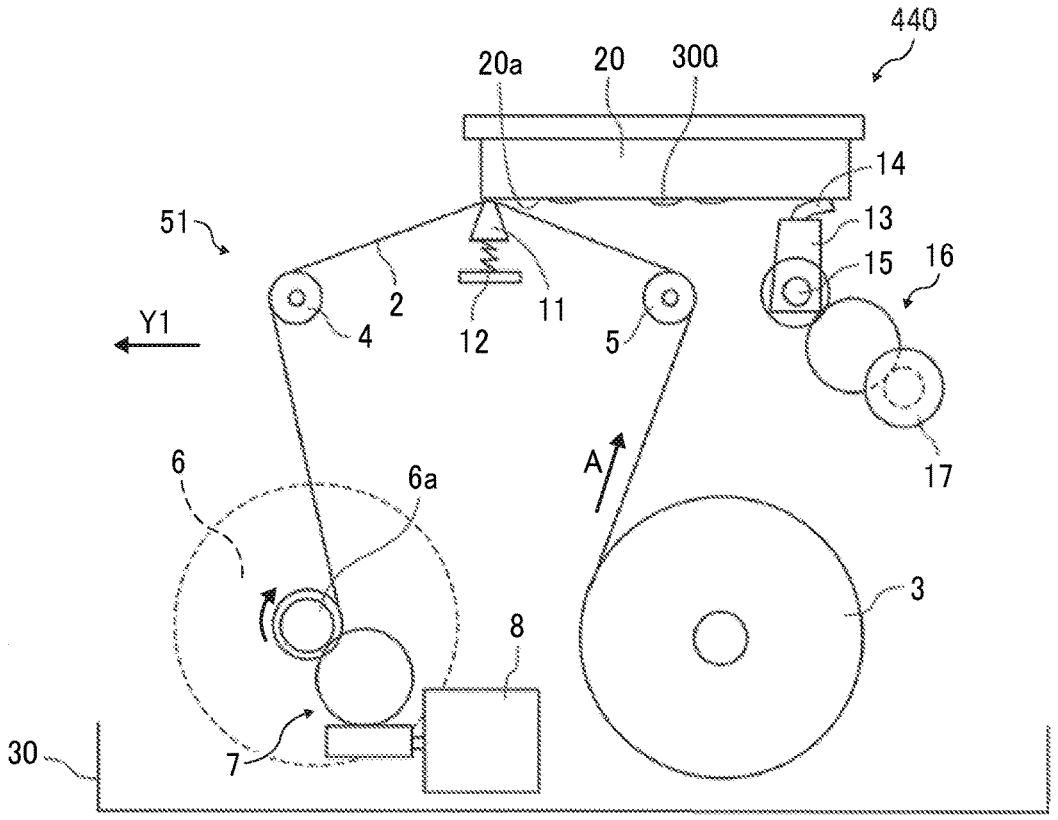

Then, as illustrated in FIG. 4B, the movable platform 30 moves in the wiping direction Y1. Thus, the liquid (waste liquid) 300 remained on the nozzle face 20*a* of the head 20 is wiped and absorbed (thus removed) by the web 2.

Next, when the web 2 moves to a predetermined position, the blade 14 comes into contact with the nozzle face 20*a* from the one end part of the nozzle face 20*a*. The blade 14 wipes the waste liquid 300 remained after the wiping by the web 2 as the movable platform 30 moves in the wiping direction Y1.

Figure 4C:
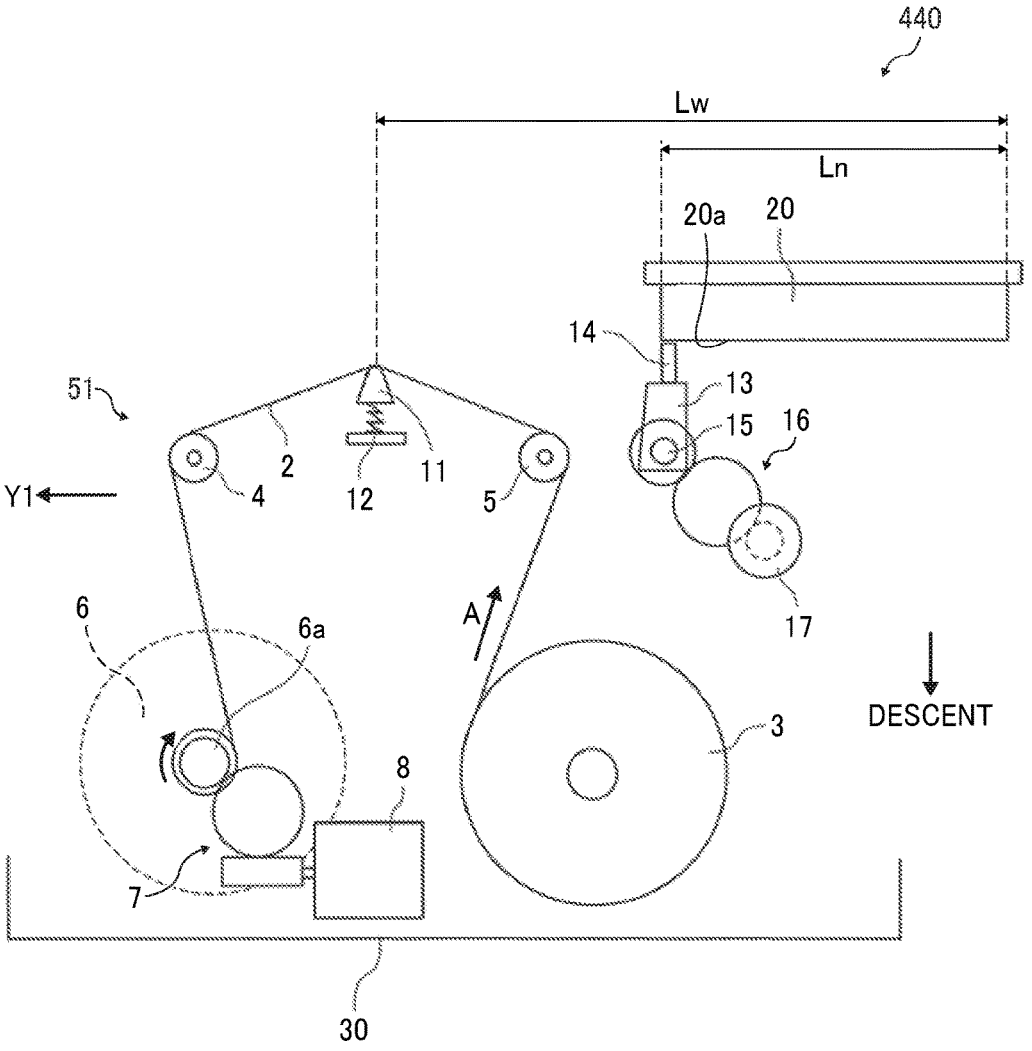

Then, as illustrated in FIG. 4C, at a position where the blade 14 reaches to another end of the nozzle face 20*a* (wiping end position), the movement of the movable platform 30 in the wiping direction Y1 is stopped. Then, the movable platform 30 is descent to separate the blade 14 from the nozzle face 20*a*.

Thus, the present embodiment can prevent the waste liquid adhered on the blade 14 to be thrown away and scattered in a front side in the wiping direction Y1 by the blade 14 when the blade 14 is returned to the upright status from the deformed status. Thus, the wiper 51 can prevent the scattered waste liquid from contaminating the wiper 51.

Here, the web 2 has almost no water repellency. In other words, the web 2 has a liquid absorbability to a certain extent. Thus, the web 2 can efficiently remove waste liquid adhered to the nozzle face 20*a*. Particularly, the web 2 increases an ability to remove waste liquid when cleaning liquid is applied on and permeated through the web 2. The cleaning liquid is described below in detail.

Conversely, waste liquid or cleaning liquid permeated in the web 2 may be exuded from the web 2 to the nozzle face 20*a* by the pressing force depending on conditions. Thus, the waste liquid may remain on the nozzle face 20*a*. Further, the web 2 may also absorb the liquid inside the nozzle 201 formed in the nozzle face 20*a* and destroy meniscus in the nozzle 201.

Therefore, the wiper 51 of the present embodiment wipes the nozzle face 20*a* with the web 2 (wiper sheet) and then wipes the nozzle face 20*a* with the blade 14 having higher water repellency (lower absorbability) than the web 2. Thus, the wiper 51 of the present embodiment can prevent the waste liquid from remaining on the nozzle face 20*a* by ending the wiping of the nozzle face 20*a* in a series of wiping operations with the blade 14.

Performing a final wiping of the nozzle face 20*a* with the blade 14 can reduce an influence of the wiping operation on the formation of the meniscus in the nozzle 201 as compared with performing the final wiping of the nozzle face 20*a* with the web 2. Thus, the present embodiment can reduce a number of nozzles 201 in which the meniscus is broken.

This effect may be obtained by a movement of the blade 14 that moves while stroking a vicinity of the opening of the nozzle 201, thus assisting the formation of the meniscus by a surface tension of the liquid in the nozzle 201. However, above description does not limit the mechanism of generating the effect.

Particularly, the wiper 51 of the present embodiment can effectively wipe the nozzle face 20*a* by using the blade 14 made of a material having a lower absorbability than the absorbability of the web 2 because the blade 14 hardly absorbs the ink inside the nozzle 201. The wiper 51 can effectively wipe the nozzle face as long as the second wiper has the lower absorbability than the absorbability of the first wiper. The first wiper (web 2) contacts the nozzle face 20*a* prior to the second wiper (blade 14). The second wiper (blade 14) then contacts the nozzle face 20*a* after the wiping operation by the first wiper (web 2). Therefore, it is also possible to use a web or the like instead of the blade 14 as the second wiper.

As illustrated in FIG. 4C, the distance (length) of the nozzle face 20*a* in the wiping direction Y1 is indicated as "Ln". The moving distance of the movable platform 30 in the wiping direction Y1 in the above-described wiping operation is indicated as "Lw".

The moving distance Lw of the movable platform 30 is a distance from a point where the pressing member 11 starts contacting the nozzle face 20*a* to a point where the pressing member 11 is positioned when the wiping operation completes. As illustrated in FIG. 4C, the moving distance Lw of the movable platform 30 is larger than the distance (length) Ln of the nozzle face 20*a*.

[Strong Cleaning]

As described above, in the first wiping operation as illustrated in FIG. 5 the blade 14 does not contact the nozzle face 20*a*, whereas in the second wiping operation as illustrated in FIG. 4 the blade 14 contacts the nozzle face 20*a*.

A wiping operation referred to herein as "strong cleaning" in which the first wiping operation and the second wiping operation are combined is described below. Strong cleaning can be used, for example, when a considerable time has elapsed since a last discharge of liquid from the nozzle 201 of the head 20 so that the nozzle face 20*a* is remarkably contaminated by the waste liquid.

First, the wiper 51 repeats the first wiping operation in which the blade 14 does not contact the nozzle face 20*a* multiple times. Thus, the wiper 51 can further reliably remove the waste liquid attached to the nozzle face 20*a*.

Then, the blade 14 performs the second wiping operation in which the blade 14 contacts the nozzle face 20*a*. In other words, the wiper 51 performs the final wiping of the nozzle face 20*a* with the blade 14 in the end of a series of wiping operations. Thus, the wiper 51 can reliably removes the waste liquid adhered to the nozzle face 20*a* while removing waste liquid exuded from the web 2. Further, the wiper 51 can maintain meniscus in the nozzles 201

Repeating the second wiping operation with the blade 14 multiple times can increase a cleaning power. However, the time taken for the wiping operation also increases because the moving distance Lw of the movable platform 30 in the second wiping operation is longer than the moving distance Lw in the first wiping operation.

On the other hand, the wiping operation as described above can reduce the time taken for the wiping operation since this wiping operation repeats the first wiping operation for a plural times in which the moving distance Lw of the movable platform 30 is shorter than the second wiping operation.

Second Embodiment

Figure 6:
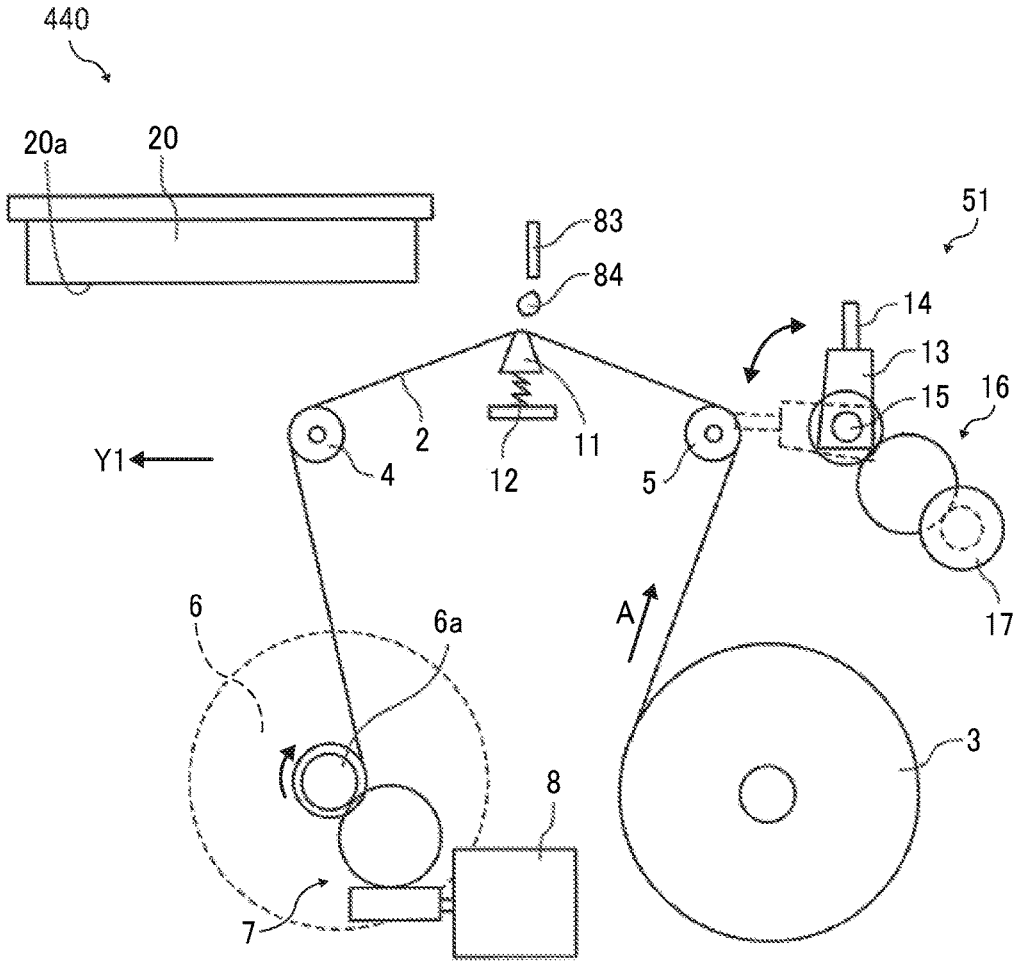
FIG. 6 is a schematic side view of a wiper according to a second embodiment of the present disclosure.
Figure 7:
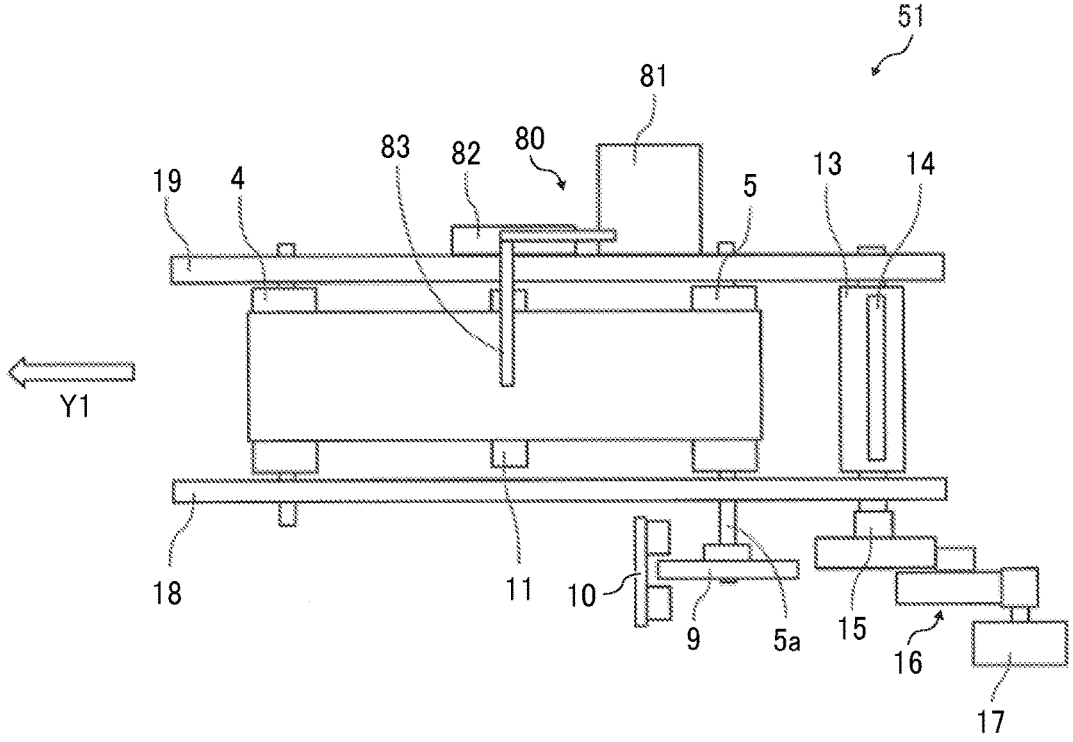
FIG. 7 is a schematic plan view of the wiper according to the second embodiment of the present disclosure.

Next, a second embodiment of the present disclosure is described with reference to FIGS. 6 and 7. FIG. 6 is a schematic side view of the wiper 51 according to the second embodiment. FIG. 7 is a plan view of the wiper 51 of FIG. 6.

To the configuration of the first embodiment described above, the second embodiment has a configuration including a coating mechanism for applying a cleaning liquid 84 to the web 2 as the wiper sheet is described. Hereinafter the coating mechanism is also referred to as "cleaning liquid application device".

Moreover, the wiper 51 according to the second embodiment further includes a cleaning-liquid application device 80 in the first embodiment. The cleaning-liquid application device 80 applies the cleaning liquid 84 to the web 2 before the wiper 51 performs the first wiping operation.

The cleaning-liquid application device 80 includes a supply pump 81, a supply tube 83, and a stand 82. The supply pump 81 supplies cleaning liquid 84 to the web via the supply tube 83. The stand 82 supports the crawled supply tube 83.

Thus, as illustrated in FIG. 6, the waste liquid adhered on the nozzle face 20*a* can be reliably absorbed and removed by the web 2 by applying (dropping) the cleaning liquid 84 to the web 2 before wiping the nozzle face 20*a* by the web 2.

A supply amount of the cleaning liquid 84 is controlled by controlling a drive time of the supply pump 81. The supply amount of the cleaning liquid 84 may be varied.

The application timing of the cleaning liquid 84 can be arbitrarily set. In the above-described strong cleaning, in terms of detergency, the cleaning liquid 84 is preferably dropped each time when the first wiping operation is completed. The strong cleaning performs the second wiping operation after repeating the first wiping operation at least once.

On the other hand, in terms of time efficiency, the cleaning liquid 84 is preferably dropped onto the web 2 before the first wiping operation is first performed, and the cleaning liquid 84 is not dropped onto the web 2 when the wiper 51 repeats the first wiping operation.

According to the present embodiment, not only the wiping time is shortened but also the time for dripping the cleaning liquid 84 is shortened.

Thus, the present embodiment can prevent the cleaning liquid 84 and the waste ink adhered to the nozzle face 20*a* from drying and solidifying again to remain on the nozzle face 20*a*.

Third Embodiment

Figure 8:
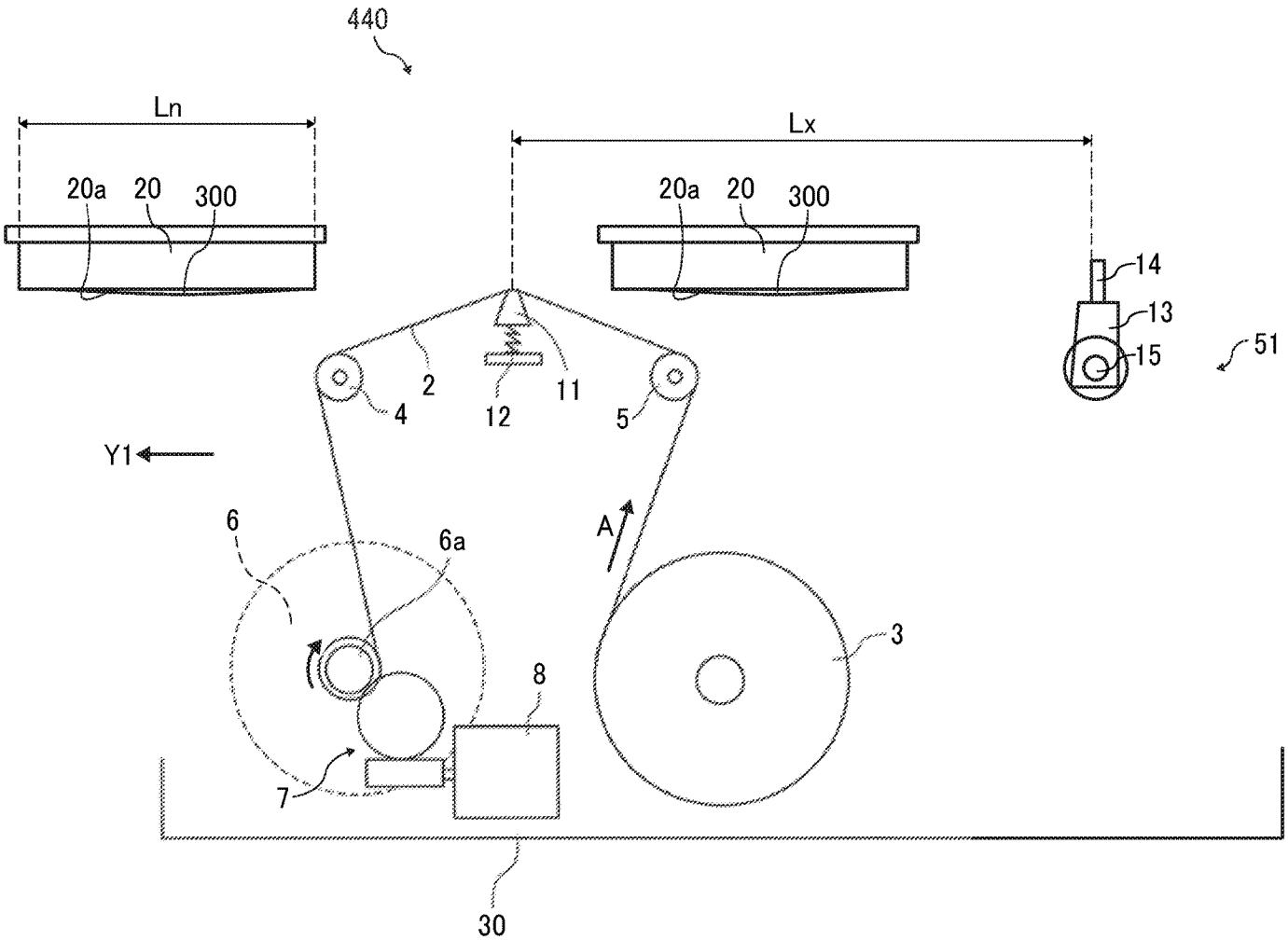
FIG. 8 is a schematic side view of a wiper according to a third embodiment of the present disclosure.

Next, a third embodiment of the present disclosure is described with reference to FIG. 8. FIG. 8 is a schematic side view of the wiper 51 according to the third embodiment.

Figure 2:
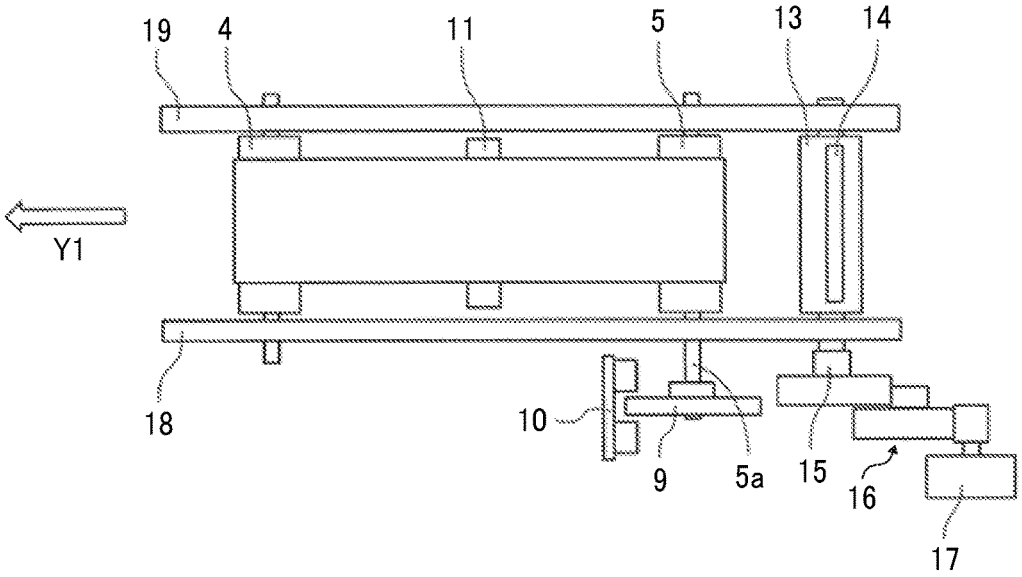
FIG. 2 is a schematic plan view of the wiper according to the first embodiment of the present disclosure.

In FIG. 8, a distance Lx between the pressing member 11 of the web 2 and the blade 14 in the wiping direction Y1 is longer than a distance between the pressing member 11 and the blade 14 in the first embodiment as illustrated in FIGS. 1 and 2.

As the distance Lx between the web 2 and the blade 14, for example, the distance between a position at which the web 2 wipes the nozzle face 20*a* (the position of the pressing member 11, for example) and a position at which the blade 14 wipes the nozzle face 20*a* is used.

In the present embodiment, the distance Lx between the pressing member 11 and the blade 14 in the wiping direction Y1 is made larger than the distance (length) Ln of the nozzle face 20*a*. Thus, the third embodiment can perform the first wiping operation in which the blade 14 does not contact the nozzle face 20*a* without using a motor to rotate the blade 14, for example.

Further, this third embodiment may be applied to an apparatus in which a plurality of heads is arranged such as a so-called line-type inkjet apparatus. Then, the apparatus can increase the time efficiency by adjusting an arrangement interval of the heads 20 so that the web 2 wipes the head 20 while the blade 14 wipes the head 20.

Fourth Embodiment

Figure 9:
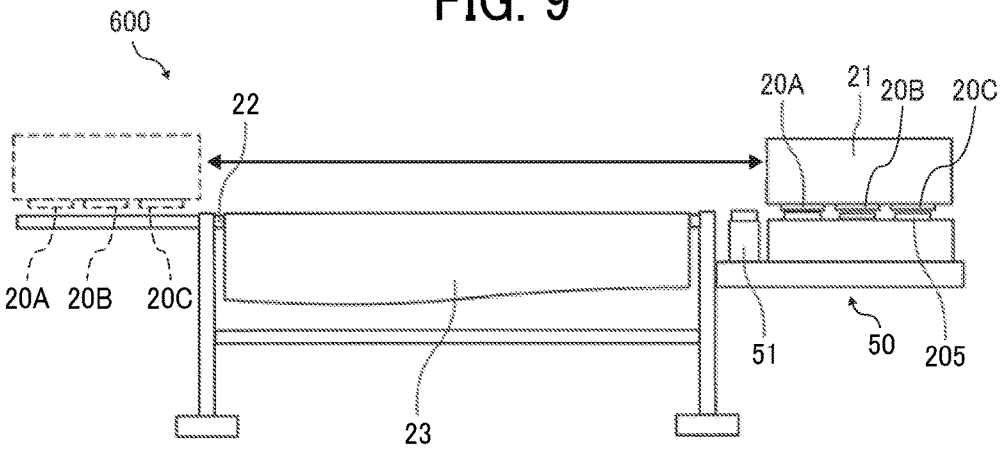
FIG. 9 is a front view of a liquid discharge apparatus according to the present disclosure.

FIG. 9 is a front view of a liquid discharge apparatus 600 according to the fourth embodiment of the present disclosure. The liquid discharge apparatus 600 includes the head cleaner 50 as described above.

The liquid discharge apparatus 600 is a serial type apparatus in which one or a plurality of heads 20 (heads 20A to 20C in FIG. 2, for example) are mounted on the carriage 21. A conveyor 22 intermittently conveys a medium 23. Then, the carriage 21 is reciprocally moved in the direction of the arrow, and the heads 20 discharge required liquid to form an image.

Further, the liquid discharge apparatus 600 includes a head cleaner 50 on a home position side (right-hand side in FIG. 9) of the carriage 21. The head cleaner 50 includes a cap 205 for capping the nozzle face 20*a* of the heads 20 and the wiper 51 as described above for maintaining and recovering the heads 20.

Figure 10A:
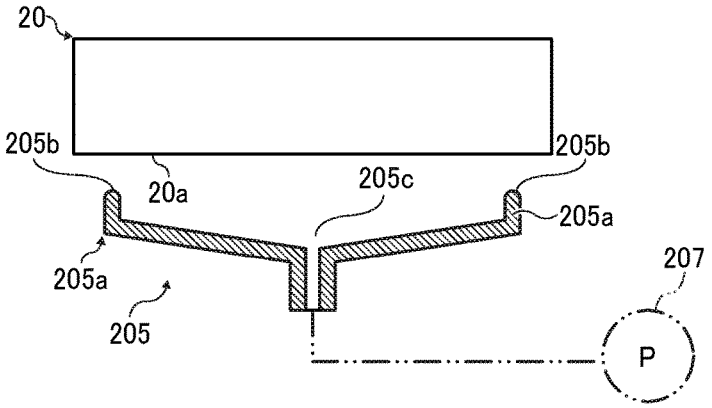
FIG. 10A is a side view of a cap and the liquid discharge head.
Figure 10B:
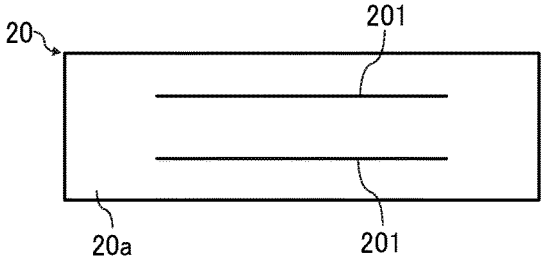
FIG. 10B is a plan view of a nozzle face of the liquid discharge head.

FIG. 10A is a cross-sectional view of the head 20 and the cap 205. FIG. 10B is a plan view of the nozzle face 20*a* viewed from a bottom of the head 20.

The cap 205 includes a nip 205*a* and an opening 205*c* having a size to cover and surround all the nozzles 201 of the nozzle face 20*a* of the heads 20. The nip 205*a* of the cap 205 erects toward the nozzle face 20*a* of the head 20. Further, the end 205*b* of the nip 205*a* is in contact with the nozzle face 20*a*.

A suction pump 207 for sucking liquid (ink) from the nozzle 201 of the head 20 is connected to the cap 205 so that a required amount of liquid (ink) can be sucked and stored inside the cap 205.

FIGS. 11A to 11E are cross-sectional side views of the cap 205 and the head 20 illustrating a mechanism of ink transfer from the cap 205 to the nozzle face 20*a* of the head 20.

Figure 12:
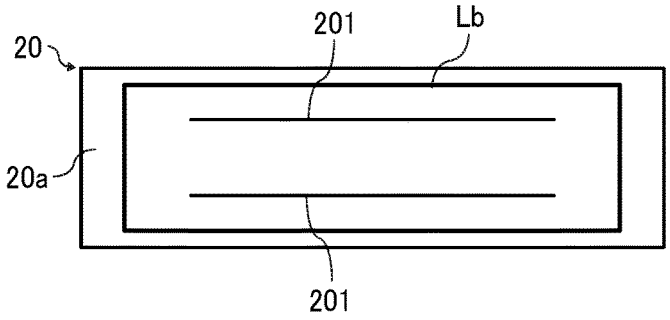
FIG. 12 is a plan view of the nozzle face of the liquid discharge head.

FIG. 12 is a plan view of the nozzle face 20*a* of the head 20 viewed from a bottom of the head 20.

Figure 11A:
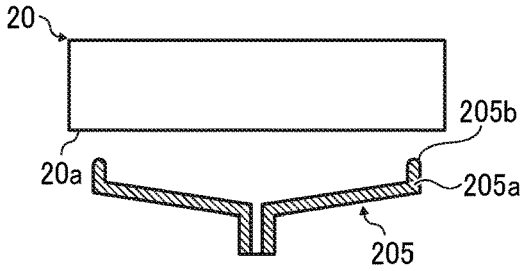
FIGS. 11A through 11E are side views of the cap and the liquid discharge head during a suction operation.
Figure 11B:
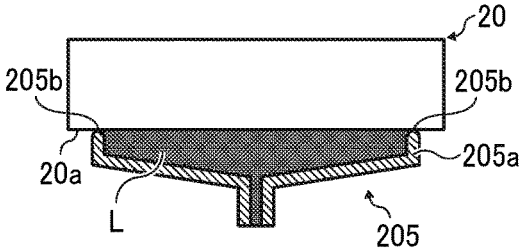
Figure 11C:
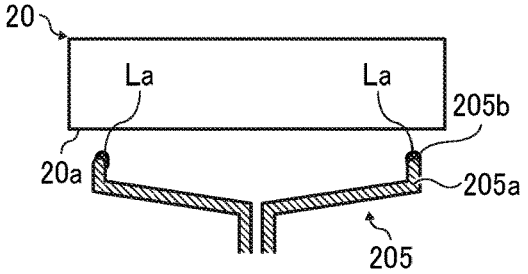
Figure 11D:
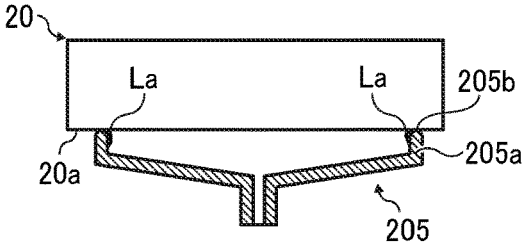
Figure 11E:
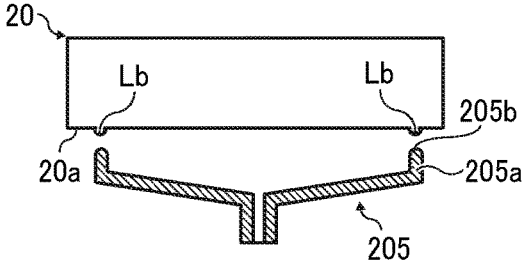

FIG. 11A illustrates a state in which the head 20 and the cap 205 are separated from each other. FIG. 11B illustrates a state in which the head 20 and the cap 205 are in contact with each other. FIG. 11C illustrates a state in which ink La adheres to the end 205*b* of the nip 205*a* of the cap 205. FIG. 11D illustrates a state in which the end 205*b* of the nip 205*a* to which ink is adhered is in contact with the head 20. FIG. 11E illustrates a state in which the ink La adhered to the end 205*b* of the nip 205*a* is transferred to the nozzle face 20*a* of the head 20.

FIGS. 11A to 11E illustrate a case in which the cap 205 moves relative to the head 20. However, the head 20 may move relative to the cap 205.

As illustrated in FIG. 11A, a capping operation starts from a state in which the nozzle face 20*a* of the head 20 and the cap 205 are separated during a maintenance operation of the head 20.

Next, as illustrated in FIG. 11B, the end 205*b* of the cap 205 is brought into contact with the nozzle face 20*a* of the head 20. Then, ink is removed from the nozzles 201 by the suction pump 207 described above.

After completion of the suction operation with the suction pump 207, the cap 205 moves downward from the nozzle face 20*a* to a lower position to be separated from the nozzle face 20*a* as illustrated in FIG. 11C.

At a time of the capping operation as described above, the ink La adheres to the end 205*b* of the cap 205 that contacts the nozzle face 20*a*. If the capping operation as illustrated in FIG. 11D is performed while the ink is adhered to the end 205*b* of the cap 205, the ink Lb adhered on the end 205*b* of the cap 205 is transferred onto the nozzle face 20*a* as illustrated in FIGS. 11E and 12. As illustrated in FIG. 12, the ink Lb transferred and adhered on the nozzle face 20*a* surrounds the nozzles 201 in the nozzle face 20*a*. This trace of ink Lb adhered on the nozzle face 20*a* is referred to as a "nip mark".

The above-described liquid discharge apparatus 600 includes a control mechanism (hereinafter also referred to as "controller") for controlling each unit of the liquid discharge apparatus 600. The controller 500 is illustrated in FIG. 17.

The controller 500 controls each unit of the apparatus 600, including a liquid discharge device 440. The liquid discharge device 440 includes, for example, the head 20 and the head cleaner 50 including the wiper 51.

Figure 17:
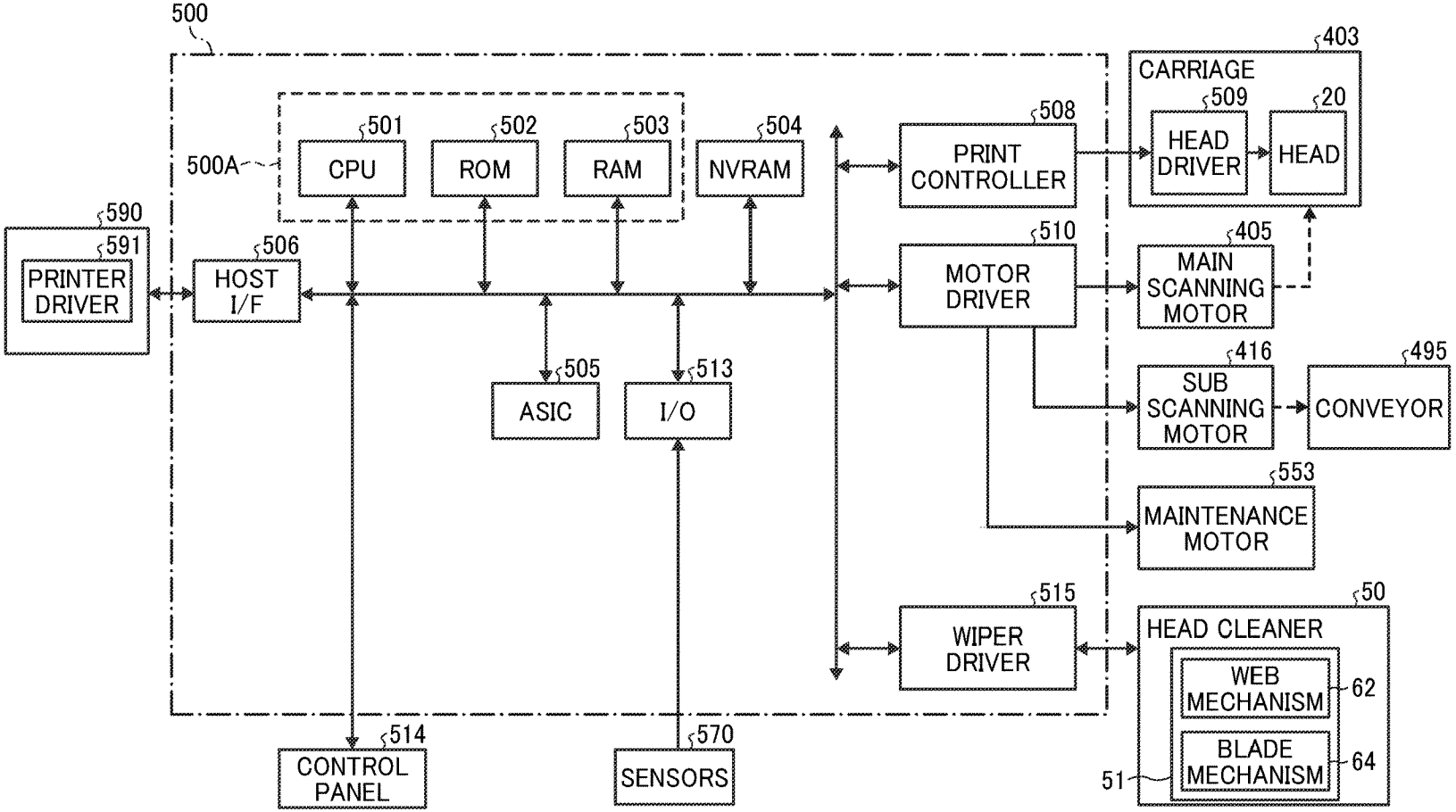
FIG. 17 is a block diagram of a controller of the liquid discharge apparatus.

In the present embodiment, a mode in which the controller 500 controls the wiping operation of the wiper 51 of the head cleaner 50 based on the wiping condition is described, together with a specific configuration of the controller 500, with reference to FIG. 17.

The controller 500 of the liquid discharge apparatus 600 according to the present embodiment includes a memory that stores information for controlling the head cleaner 50, such as time at a completion of last printing operation (immediately preceding printing operation). The head 20 discharges liquid (ink) from the nozzles 201 in the printing operation for executing a print job.

Here, the printing operation is an operation that discharges ink from the head 20.

The memory may be installed in an area where the controller 500 can read and write the information. The memory may be a random access memory (RAM) 503 as illustrated in FIG. 17, for example.

For example, the controller 500 may change the wiping condition according to an elapsed time from the previously set time stored in the memory when the wiping operation is performed by bringing the web 2 into contact with the nozzle face 20*a* of the head 20.

Hereinafter, means for performing this function that changes the wiping condition of the wiping operation is referred to as "wiping condition changer".

A controller 500 as illustrated in FIG. 17 serves as the wiping condition changer. An example of the "wiping conditions" is described below.

(1) A Wiping Speed of Wiping the Nozzle Face 20*a*

A wiping performance can be improved by setting the wiping speed at the time of wiping the nozzle face 20*a* to be slower than a normal wiping operation.

(2) A Wiping Pressure of Wiping the Nozzle Face 20*a*

The wiping performance can be improved by increasing the wiping pressure for wiping the nozzle face 20*a* to be larger than the wiping pressure of the normal wiping operation.

(3) A Number of Times of Wiping the Nozzle Face 20*a*

The wiping performance can be improved by increasing the number of times of wiping the nozzle face 20*a* to be larger than the number of times of wiping in the normal wiping operation.

(4) A Wiping Direction of Wiping the Nozzle Face 20*a*

The wiper 51 can reduce an amount of remaining ink adhered on the nozzle face 20*a* after the wiping operation generated by bias in the wiping direction by appropriately changing the wiping direction of the nozzle face 20*a* with the wiper 51. The wiper 51 wipes the nozzle face 20*a* of the head 20 based on the wiping condition changed by the wiping condition changer (controller 500).

The liquid discharge device 440 includes sensors 570 illustrated in FIG. 17. The sensors 570 can measure temperature and humidity in a vicinity of the nozzle face 20*a* of the head 20. Thus, the wiping condition changer (controller 500) changes the wiping condition according to the temperature and humidity detected by the sensors 570 when the wiping operation is performed by bringing the web 2 into contact with the nozzle face 20*a* of the head 20.

Next, changing of the wiping conditions of the wiping operation is described in detail with reference to FIGS. 13A-13C.

Figure 13A:
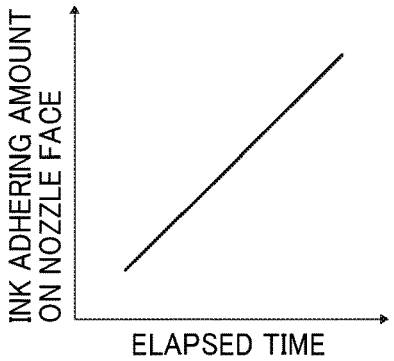
FIGS. 13A through 13C are graphs illustrate a relationship between amount of ink adhering to the nozzle face and elapsed time, a relationship between a moisture evaporation rate and a temperature, a relationship between a moisture evaporation rate and a humidity, respectively.
Figure 13B:
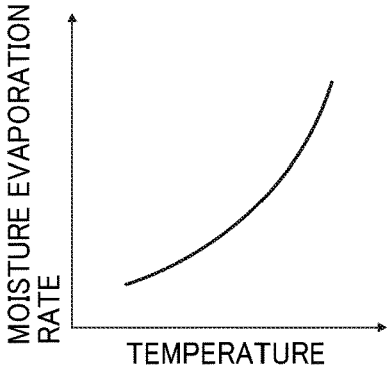
Figure 13C:
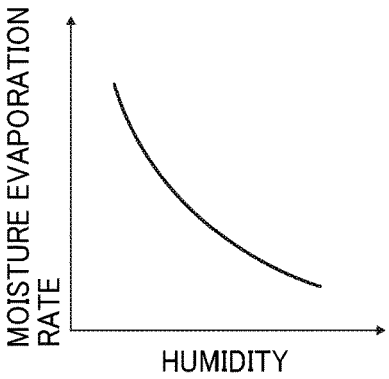

FIG. 13A is a graph illustrating a relationship between an amount of ink adhered the nozzle face 20*a* (ink adhering amount) and the elapsed time. FIG. 13B is a graph illustrating a relationship between a moisture evaporation rate and a temperature. FIG. 13C is a graph illustrating a relationship between a moisture evaporation rate and a humidity.

The nip mark is formed on the nozzle face 20*a* by transferring the ink adhered on the end 205*b* (nip) of the cap 205 onto the nozzle face 20*a*. As illustrated in FIG. 13A, the amount of ink adhering to the nozzle face 20*a* (amount of ink of the nip mark) increases with the elapsed time when the liquid discharge apparatus 600 is in a standby state and is not performing a print job. The liquid discharge apparatus 600 includes the liquid discharge device 400 as illustrated in FIGS. 1 through 8.

Thus, the wiper 51 may not sufficiently remove the ink adhered on the nozzle face 20*a* (nip mark) by the normal wiping operation when the liquid discharge apparatus 600 is left for a long time without performing the print job.

Therefore, the wiper 51 performs a wiping operation that is different from the normal wiping operation in wiping conditions when a predetermined period of time has elapsed in the standby state in which the liquid discharge apparatus 600 does not perform a print job. Thus, the wiper 51 can sufficiently remove the ink adhered on the nozzle face 20*a* (nip mark).

The normal wiping operation is periodically performed for recovering a discharge performance of the nozzle 201 when the liquid discharge apparatus 600 performs a printing operation. The normal wiping operation is also performed at an arbitrary timing according to the needs of the user of the liquid discharge apparatus 600.

As described above, the wiping conditions includes, for example, the wiping speed, the wiping pressure, the number of times of wiping, and the wiping direction for wiping the nozzle face 20*a* with the web 2. Further, the wiping condition includes an amount of liquid applied on the web 2 when the wiper 51 includes the cleaning-liquid application device 80. Further, the wiping condition includes a time interval between the wiping operations when the wiper 51 wipes the nozzle face 20*a* multiple times with the web 2 to which the cleaning liquid 84 is applied.

The wiper 51 including the cleaning-liquid application device 80 controls the amount of the cleaning liquid applied on the web 2 as the wiping condition. Further, the wiper can efficiently remove the ink adhered on the nozzle face 20*a* by increasing the time interval between the wiping operations if the time interval is within the drying time of the cleaning liquid when the wiper 51 wipes the nozzle face 20*a* multiple times with the web 2 applied with the cleaning liquid 84.

The wiper 51 can control the removal performance of the ink adhered to the nozzle face 20*a* by changing the wiping condition. Further, the wiper 51 may perform the wiping operation with a wiping condition different from the wiping condition of the normal wiping operation at a time when a new print job is received from the standby state in which the printer does not perform the print job.

In that case, the wiper 51 preferably controls the wiping performance by changing the wiping condition according to a length of time elapsed from the time of the last printing operation (ink discharge operation) to the reception of the new print job.

Further, the wiper 51 may include a configuration in which the user of the liquid discharge apparatus 600 sets a time in advance. The wiper 51 automatically performs a wiping operation having a wiping condition different from the normal wiping operation when the time is reached.

For example, the controller 500 (wiping condition changer) stores an elapsed time that has elapsed since the last printing operation (ink discharge operation) by the head 20 in the memory such as RAM 503.

The wiper 51 preferably performs second wiping operation after performing the first wiping operation multiple times when the elapsed time stored in the memory (RAM 503) exceeds a threshold value when starting the wiping operation. The threshold value is a preset value for determining the elapsed time.

At this time, the wiper 51 receives an instruction of the wiping operation to be executed from the controller 500. Then, the wiper 51 executes the wiping operation according to the receipt instruction.

For example, the instruction is to execute the second wiping operation once after executing the first wiping operation for n times (n is a positive integer).

Further, the liquid discharge apparatus 600 may hold the threshold value for determining the elapsed time by holding a preset value in a device such as the memory (RAM 503) or by holding a value input or changed from an outside the liquid discharge apparatus 600 via an interface such as an operation panel.

In the above description, the wiping condition is changed according to a length of time elapsed from a completion of last printing operation (immediately preceding printing operation) until receipt of a new print job.

Here, the printing operation is performed by discharging ink from the nozzles 201 of the head 20. Thus, the wiper 51 can control a performance of ink removal. However, the wiping condition may be changed as described below.

When the wiping condition is changed according to the temperature and the humidity in the vicinity of the nozzle face 20*a* of the head 20 as described above, the wiping condition of the wiping operation is preferably determined according to a degree of drying of the ink adhered on the nozzle face 20*a*.

Generally, the moisture evaporation rate from liquid such as ink depends on the ambient temperature and humidity at that time. Specifically, the higher the temperature and the lower the humidity, the higher the moisture evaporation rate becomes as illustrated in FIGS. 6A and 6B.

Therefore, the wiper 51 changes the wiping condition according to an average value of the temperature and the humidity in the vicinity of the nozzle face 20*a* of the head 20 over time for a length of time until a predetermined time has elapsed from the completion of the last printing operation.

Further, the wiper 51 may change the wiping condition according to a maximum value of the temperature and a minimum value of the humidity over time for a length of time until a predetermined time has elapsed from the completion of the last printing operation.

Further, the wiper 51 may change the wiping condition as described below when the wiping operation different from the normal wiping operation is performed at a timing when the new print job is received from the standby state where the printer (liquid discharge apparatus) does not perform print job.

That is, the wiper 51 changes the wiping condition according to the average value of the temperature and the humidity in the vicinity of the nozzle face 20*a* of the head 20 or the maximum value of the temperature and the minimum value of the humidity during the time from a completion of last printing operation until receipt of a new print job.

Thus, the wiper 51 can reduce an amount of consumption of the web 2 by changing the wiping condition according to the temperature and the humidity in the vicinity of the nozzle face 20*a*.

Figure 14A:
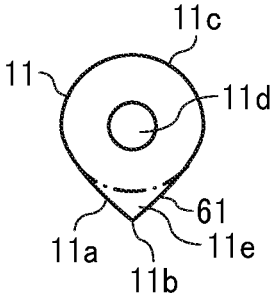
FIGS. 14A and 14B are side views of a pressing member.
Figure 14B:
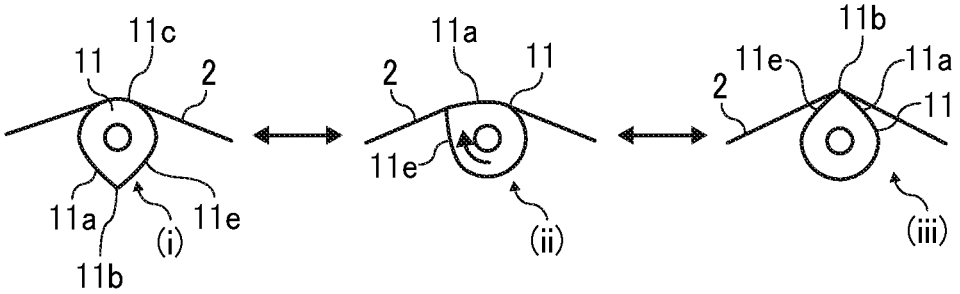

FIGS. 14A and 14B illustrate another example of changing the wiping pressure when the web 2 wipes the nozzle face 20*a*. FIG. 14A is an enlarged cross-sectional view of the pressing member 11 according to a present disclosure. FIG. 14B is a cross-sectional view of the pressing member 11 when the wiping pressure is changed by a pressing member according to the present disclosure.

Means for changing the wiping pressure is not limited by changing a spring constant and a natural length of the compression coil spring 43 as described above. The wiping pressure may be arbitrary changed by using following pressing member as illustrated in FIGS. 14A and 14B.

The pressing member 11 according to the present disclosure includes a tip portion 11*b* of a convex portion 61 formed by intersecting two contact surfaces 11*a* and 11*e* at a given angle on a part of the outer peripheral portion 11*c* of the pressing member 11. In FIGS. 14A and 14B, the pressing member 11 is a roller driven to rotate about a shaft 11*d*.

The wiper 51 according to the present disclosure can appropriately increase or decrease the wiping pressure by rotating the pressing member 11 for a given angle so that the outer peripheral portion 11*c* as illustrated in (i), the contact surface 11*a* as illustrated in (ii), or the tip portion 11*b* as illustrated in (iii) is pressed against the web 2 as illustrated in FIG. 14B.

Next, following describes about changing an operation condition of the cleaning-liquid application device 80.

For example, the controller 500 (wiping condition changer) changes waiting time between each wiping operations to be smaller than at least drying time of the cleaning liquid 84 when the nozzle face 20*a* is wiped with the web 2, to which the cleaning liquid 84 is applied, multiple times by one wiping operation.

For example, the wiper 51 preferably does not apply the cleaning liquid 84 to the web 2 while the wiper 51 performs the first wiping operation multiple times. In other words, the wiper 51 preferably does not additionally apply the cleaning liquid 84 to the web 2 after applying the cleaning liquid 84 at a start of the plurality of first wiping operations.

Thus, the cleaning liquid 84 permeates into the ink in a state where the cleaning liquid 84 is transferred from the web 2 to the nozzle face 20*a*. Thus, the wiper 51 can efficiently remove the ink adhered on the nozzle face 20*a*.

Further, the controller 500 (wiping condition changer) may change the amount of the cleaning liquid 84 applied to the web 2 in the configuration in which the wiper 51 includes the cleaning-liquid application device 80.

For example, the wiper 51 changes the amount of cleaning liquid 84 applied to the web 2 as the wiping condition when the wet wiping is performed. The wiper 51 can improve the wiping performance by increasing the amount of the cleaning liquid 84 applied to the web 2.

In addition, the wiper 51 can reduce a consumption of the cleaning liquid 84 by reducing a frequency of the application of the cleaning liquid 84 to the web 2 more than necessary.

A highly volatile solvent may be used as the cleaning liquid 84. Thus, the wiper 51 can efficiently remove the ink and foreign matter, for example, adhered on the nozzle face 20*a* of the head 20.

The cleaning liquid 84 having a function of dissolving the ink is also preferably used. Further, the wiper 51 preferably includes a cover to cover the cleaning-liquid application device 80 so that the cleaning-liquid application device 80 does not contact the atmosphere since the cleaning liquid 84 has high volatility.

Figure 15:
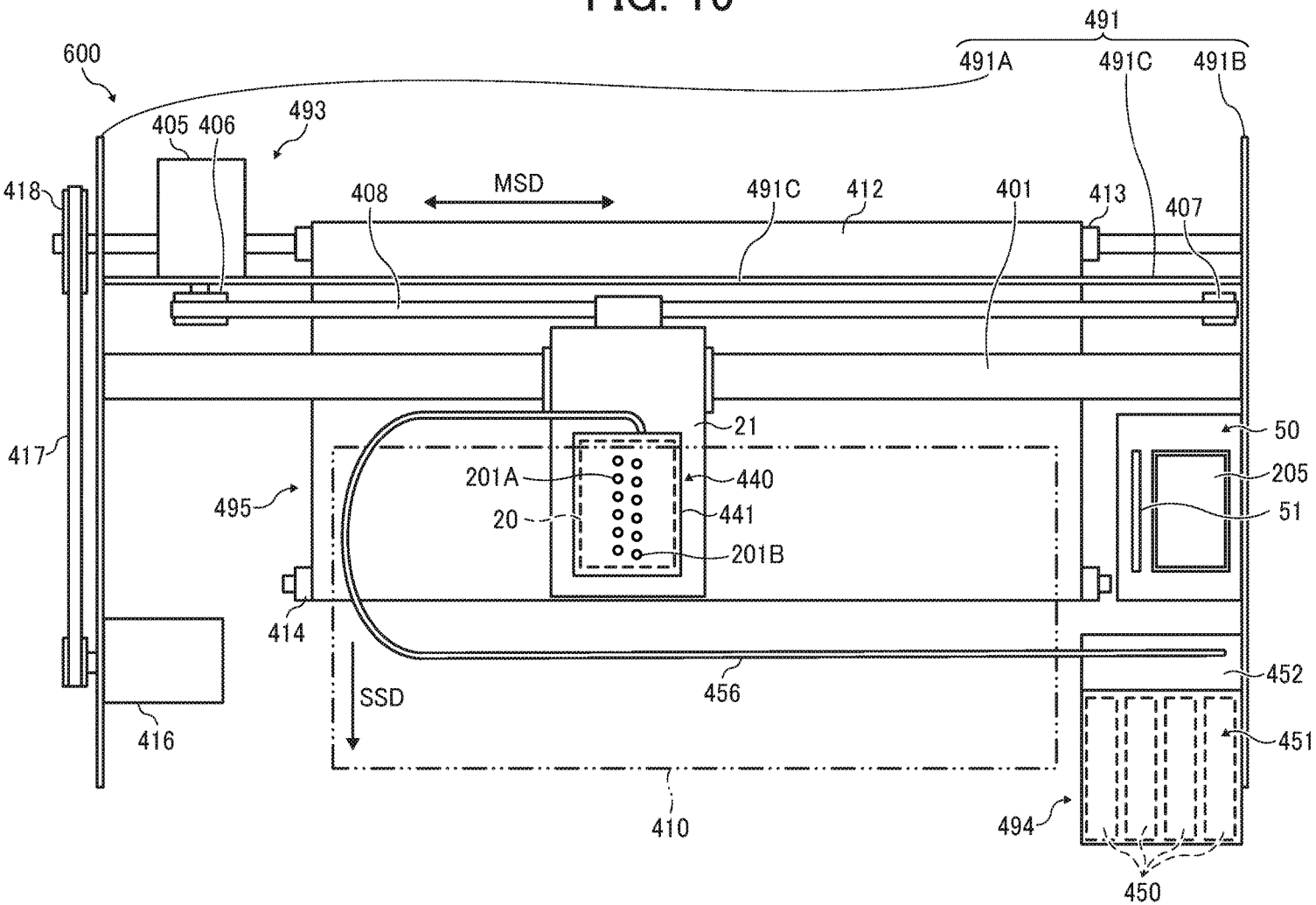
FIG. 15 is a plan view of the liquid discharge apparatus according to an embodiment of the present disclosure.
Figure 16:
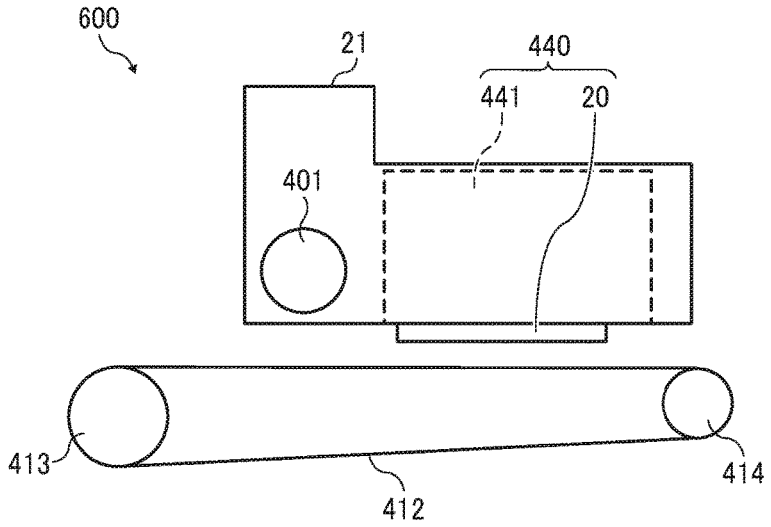
FIG. 16 is a side view of the liquid discharge apparatus in FIG. 15.

FIGS. 15 and 16 illustrate a liquid discharge apparatus 600 mounting the above-described liquid discharge device. FIG. 15 is a plan view of a portion of a liquid discharge apparatus 600 according to an embodiment of the present disclosure. FIG. 16 is a side view of the liquid discharge apparatus in FIG. 15.

The liquid discharge apparatus 600 according to the present disclosure is a serial-type apparatus in which a main scan moving unit 493 reciprocally moves a carriage 403 in a main scanning direction indicated by arrow MSD in FIG. 15.

The main scan moving unit 493 includes a guide 401, a main scanning motor 405, and a timing belt 408, etc. The guide 401 spans a gap between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the head 20 according to the present embodiment and a head tank 441 are integrated as a single unit. Preferably, the liquid discharge device 440 includes the head cleaner 50 of each embodiments as described above.

The head 20 of the liquid discharging device 440 discharges color liquids of, for example, yellow (Y), cyan (C), magenta (M), and black (K). The head 20 includes nozzle arrays 201A and 201B, each including the plurality of nozzles 201 arrayed in row in a sub-scanning direction indicated by arrow SSD in FIG. 15. The sub-scanning direction (SSD) is perpendicular to the main scanning direction MSD. The head 20 is mounted to the carriage 403 so that ink droplets are discharged downward (See FIGS. 1 and 3).

The liquid stored outside the head 20 is supplied to the head 20 via a supply unit 494 that supplies the liquid from a liquid cartridge 450 to the head tank 441.

The supply unit 494 includes, e.g., a cartridge holder 451 as a mount part (loading unit) to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 600 includes a conveyor 495 that attracts the sheet 410 and conveys the sheet 410 at a position facing the head 20. The conveyor 495 includes a conveyance belt 412 as an endless conveyor and a sub scanning motor 416 to drive the conveyance belt 412. The sheet 410 is attracted to the conveyance belt 412 by electrostatic force or air aspiration.

The conveyance belt 412 is wound around the conveyance roller 413 and a tension roller 414. The conveyance roller 413 is rotated by a sub scanning motor 416 via a timing belt 417 and a timing pulley 418, so that the conveyance belt 412 circulates in a sub-scanning direction (SSD) in FIG. 15.

At one side in the main scanning direction (MSD) of the carriage 403, a head cleaner 50 to recover the head 20 in good condition is disposed on a lateral side (right-hand side) of the conveyance belt 412 in FIG. 15.

The head cleaner 50 includes the wiper 51 as described above and a cap 421. The wiper 51 wipes the nozzle face 20*a* of the head 20. The cap 205 contacts and covers the nozzle face 20*a* of the head 20 to prevent drying of the nozzle face 20*a*. The wiper 51 is described above in detail with reference to FIGS. 1 to 14. Thus, the description of the wiper 51 is omitted.

The main scan moving unit 493, the supply unit 494, the head cleaner 50, and the conveyor 495 are mounted to a housing 491 that includes the left side plate 491A, the right side plate 491B, and a rear side plate 491C.

In the liquid discharge apparatus 600 thus configured, a sheet 410 is conveyed on and attracted to the conveyance belt 412 and is conveyed in the sub-scanning direction (SSD) by the cyclic rotation of the conveyance belt 412.

The head 20 is driven in response to image signals while the carriage 403 moves in the main scanning direction (MSD), to discharge liquid to the sheet 410 stopped, thus forming an image on the sheet 410. As described above, the liquid discharge apparatus 600 includes the head 20, thus allowing stable formation of high quality images.

[Control System]

FIG. 15 is a block diagram of an example of the controller 500 of the liquid discharge apparatus 600 including the wiper 51 according to the present disclosure.

The controller 500 includes a main controller 500A including a central processing unit (CPU) 501, a read only memory (ROM) 502, and a random access memory (RAM) 503. The CPU 501 controls the overall apparatus. The ROM 502 stores fixed data including various programs to be executed by the CPU 501. The RAM 503 temporarily store data such as image data.

The controller 500 further includes a non-volatile random access memory (NVRAM) 504 and an application specific integrated circuit (ASIC) 505. The NVRAM 504 is rewritable and maintains data even when the apparatus is powered off. The ASIC 505 executes various types of signal processing for image data, image processing such as rearrangement, and input and output signal processing for controlling the overall apparatus.

The controller 500 further includes a print controller 508 for driving and controlling the head 20, and a head driver (driver IC) 509 for driving the head 20. The print controller 508 includes a data transmitter and a driving signal generator. The head driver 509 is mounted on the carriage 21.

The controller 500 includes a motor driver 510 to control the main scanning motor 405, the sub scanning motor 416, and a maintenance motor 553. The main scanning motor 405 moves and scans the carriage 403. The sub scanning motor 416 drives the conveyor 495. The maintenance motor 553 moves the cap 205 of the head cleaner 50 vertically to cap the nozzle face 20*a* of the head 20. The motor driver 510 drives the maintenance motor 553 that serves as the suction pump 207 to suck the ink from the head 20 capped with the cap 205.

The controller 500 further includes a wiper driver 515 for driving the head cleaner 50 including the wiper 51.

The controller 500 further includes an input/output (I/O) unit 513. The I/O unit 513 acquires information from sensors 570 that includes various sensors mounted on the apparatus, such as a temperature sensor and a humidity sensor. The I/O unit 513 then extracts information needed for controlling the apparatus and uses the extracted information when controlling the apparatus.

The controller 500 is connected to an operation panel 514 through which necessary information for controlling the apparatus is input or displayed.

The controller 500 further includes an interface (I/F) 506 for transmitting and receiving data or signals to/from a host 590, such as an information processor (e.g., personal computer), an image reader, and an imaging device. The I/F 506 receives information from a printer driver 591 of the host 590 via a cable or network.

In the controller 500, the CPU 501 reads out print data from a receive buffer in the I/F 506 and analyzes the print data. The ASIC 505 executes necessary image processing or rearrangement of data to obtain image data. The image data is transferred from the print controller 508 to the head driver 509.

The print controller 508 transfers the image data to the head driver 509 as serial data, while outputting a transfer clock, latch signal, and control signal to the head driver 509, that are needed for transferring the image data and confirming the transfer.

The print controller 508 includes a driving signal generator that includes a D/A converter, a voltage amplifier, and a current amplifier. The D/A converter executes a digital-to-analog conversion of pattern data of driving pulse stored in the ROM 502. The print controller 508 generates a drive waveform consisting of single drive pulse or multiple drive pulses, and outputs the drive waveform to the head driver 509.

The head driver 509 selects one or more drive pulses from the drive waveform received from the print controller 508, based on serially input image data corresponding to one line of the heads 20, and gives the selected drive pulses to the pressure generators of the heads 20, thus driving the heads 20.

Thus, the head driver 509 drives the head 20. The size of dots is determined by the size of liquid droplets. The size of liquid droplets is determined depending on whether all or part of the drive pulses composing the drive waveform are/is selected, or all or part of wave components composing the drive pulse are/is selected.

Here, in this liquid discharge apparatus 600 illustrated in FIG. 17, the wiper 51 of the head cleaner 50 is composed of a web mechanism 62 including the web 2 and a blade mechanism 64 including the blade 14.

As described above, the blade mechanism 64 can move the position of the blade 14 to the first position (the position where the blade 14 contacts the nozzle face 20*a*) and the second position (the position where the blade 14 does not contact the nozzle face 20*a*). The first position is a contact position, and the second position is the retracted position.

Thus, the wiper 51 can execute the first wiping operation that wipes the nozzle face 20*a* without using the blade 14 and the second wiping operation that wipes the nozzle face 20*a* with the web 2 and the blade 14.

These wiping operations (wiping mode) correspond to the print settings of the user. For example, the controller 500 determines whether the first wiping operation or the second wiping operation is performed in the wiping operation by associating with the printing mode before the wiping operation.

Specifically, the second wiping operation using both the web 2 and the blade 14 is performed after performing a mass printing or after performing a printing using a lot of ink. On the other hand, the first wiping operation using only the web 2 without using the blade 14 is performed when number of prints is small or when an amount of ink used during a predetermined printing period is small.

As described above, the controller 500 controls the wiper 51 to perform the second wiping operation may be performed after repeating the first wiping operation at least once.

In selecting these wiping operations, a threshold value of elapsed time may be preset in advance. Then, the wiping operation to be executed may be determined according to the threshold value. Further, the wiping operation may be determined from the operation panel 514 or the host 590 side.

Further, the control unit described in the present embodiment may be realized by the controller 500 in FIG. 17.

The wiping condition changer described above can be realized by, for example, a program or a combination of a program and a hardware.

The program is stored in the ROM 502, and a group of instructions constituting the program is read into the RAM 503. Then, the instruction group is executed by the CPU 501. Further, the memory may be provided in, for example, the RAM 503, or may be provided in another memory area that can be referred by the controller 500 (for example, the CPU 501).

The head cleaner 50 in FIG. 17 may include the cleaning liquid application device 80 as described in the second embodiment in addition to the wiper 51. The control unit according to the present embodiment can be applied to each of the embodiments as described above.

The above-described liquid discharge apparatus 600 is one of an embodiment of the present disclosure, and the present embodiment is not limited to the embodiment described above. The following configuration may be adapted to the present embodiment.

The term "liquid discharge apparatus" used herein is an apparatus including the head 20 or the liquid discharge device 440 to discharge liquid by driving the head 20. The liquid discharge apparatus may be, for example, an apparatus capable of discharging liquid onto a material to which liquid can adhere or an apparatus to discharge liquid into gas or another liquid.

The liquid discharge apparatus may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, fabrication liquid, or solution and dispersion liquid including amino acid, protein, or calcium.

For example, the liquid discharge apparatus may be a serial head apparatus or a line head apparatus that does not move the liquid discharge head.

The serial head apparatus moves at least one of the head and the material on which liquid can be adhered relative to each other. For example, the serial head apparatus moves the head relative to the material on which liquid can be adhered.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

Although liquid discharge device 440 is described with reference to FIGS. 1 through 8, the above-described embodiments are not intended to limit the configuration of the liquid discharge device 440.

The liquid discharge device 440 is an integrated unit including the head 20 and a functional parts or mechanisms, and is an assembly of parts relating to liquid discharge. For example, the liquid discharge device 440 may be a combination of the head 20 with at least one of the head tank 441, the carriage 403, the supply unit 494, the head cleaner 50, and the main scan moving unit 493.

Here, the integrated unit may also be a combination in which the head 20 and a functional part(s) or a mechanism are secured to each other through, e.g., fastening, bonding, or engaging, or a combination in which one of the head 20 and a functional part(s) is movably held by another. The head 20 may be detachably attached to the functional parts or mechanisms each other.

As an example, the liquid discharge device 440 may be configured as follows.

For example, the liquid discharging device 440 may include a part in which the head 20 is integrated with the head tank 441.

The liquid discharge device 440 may include a part in which the head 20 is integrated with the head tank 441 with the tube 456. Here, a unit including a filter may further be added to a portion between the head tank 441 and the head 20 of the liquid discharge device 440.

The liquid discharge device 440 may be an integrated unit in which the head 20 is integrated with the carriage 403. In still another example, the liquid discharge device 440 may be the head 20 movably held by a guide 401 that forms part of a main scan moving unit 493, so that the head 20 and the main scan moving unit 493 are integrated as a single unit.

As illustrated in FIG. 15, the liquid discharge device 440 may be an integrated unit in which the head 20, the carriage 403, and the main scan moving unit 493 are integrally formed as a single unit.

In another example, the cap 205 that forms part of the head cleaner 50 is secured to the carriage 403 mounting the head 20 so that the head 20, the carriage 403, and the head cleaner 50 are integrated as a single unit to form the liquid discharge device 440.

Further, in another example, a tube 456 is coupled to the head 20 to which either the head tank 441 or a channel member is attached, so that the head 20 and the supply unit 494 are united into a single liquid discharge device 440. The main scan moving unit 493 may be a guide 401 only. The supply unit 494 may be a tube(s) 456 only or a cartridge holder 451 only.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head cleaner to clean a liquid discharge head including a nozzle face in which nozzles are formed, the head cleaner comprising:

a wiper to wipe the nozzle face by moving relative to the liquid discharge head in a wiping direction, the wiper including a wiper sheet and a blade having a higher water repellency than the wiper sheet; and a controller that controls the wiper to perform a first wiping operation and a second wiping operation, and controls the blade to pivot between a retracted position where the blade rotates down to contact the wiper sheet and a wiping position where the blade rotates up to contact the nozzle face, the first wiping operation wiping the nozzle face with the wiper sheet and with the blade rotated downward to avoid bringing the blade into contact with the nozzle face, the second wiping operation wiping the nozzle face with the wiper sheet and with the blade rotated upward to bring both the wiper sheet and the blade into contact with the nozzle face, wherein the controller controls the wiper to perform the second wiping operation after performing the first wiping operation at least once.

2. The head cleaner according to claim 1, wherein a moving amount of the wiper sheet in the wiping direction is equal to a length of the nozzle face in the wiping direction.

3. The head cleaner according to claim 1, wherein a direction of wiping the nozzle face with the wiper sheet is one direction when the wiper performs the first wiping operation multiple times.

4. The head cleaner according to claim 1, further comprising an application device to apply cleaning liquid to the wiper sheet, wherein the application device applies the cleaning liquid to the wiper sheet before the wiper performs the first wiping operation.

5. The head cleaner according to claim 4, wherein the application device does not apply the cleaning liquid to the wiper sheet while the wiper performs the first wiping operation multiple times.

6. The head cleaner according to claim 1, further comprising a memory to store an elapsed time that has elapsed since a last discharge of liquid by the liquid discharge head, wherein the wiper performs the second wiping operation after performing the first wiping operation multiple times when the elapsed time stored in the memory exceeds a preset threshold value.

7. A liquid discharge apparatus comprising the head cleaner according to claim 1.

* * * * *